US011858022B2

(12) United States Patent
Fairlie et al.

(10) Patent No.: US 11,858,022 B2
(45) Date of Patent: Jan. 2, 2024

(54) METHOD AND APPARATUS FOR CONTROLLING METAL STRIP PROFILE DURING ROLLING WITH DIRECT MEASUREMENT OF PROCESS PARAMETERS

(71) Applicant: NOVELIS INC., Atlanta, GA (US)

(72) Inventors: Matthew J. Fairlie, Kingston (CA); Timothy F. Stanistreet, Kennesaw, GA (US); Carlos Eboli, Kennesaw, GA (US); Hansjuerg Alder, Feuerthalen (CH); Luiz Murad, Pindamonhangaba (BR)

(73) Assignee: Novelis Inc., Atlanta, GA (US)

( * ) Notice: Subject to any disclaimer, the term of this patent is extended or adjusted under 35 U.S.C. 154(b) by 88 days.

(21) Appl. No.: 17/224,361

(22) Filed: Apr. 7, 2021

(65) Prior Publication Data

US 2021/0220885 A1 Jul. 22, 2021

Related U.S. Application Data

(63) Continuation of application No. 15/453,429, filed on Mar. 8, 2017, now Pat. No. 10,994,317, which is a (Continued)

(51) Int. Cl.
*B21B 37/74* (2006.01)
*B21B 1/22* (2006.01)
(Continued)

(52) U.S. Cl.
CPC ..... *B21B 37/74* (2013.01); *B21B 1/22* (2013.01); *B21B 37/16* (2013.01); *B21B 37/28* (2013.01);
(Continued)

(58) Field of Classification Search
CPC ..... B21B 37/74; B21B 37/16; B21B 37/28; B21B 1/22; B21B 38/02; B21B 38/04; B21B 38/10; B21B 38/12
See application file for complete search history.

(56) References Cited

U.S. PATENT DOCUMENTS 3,662,576 A 5/1972 Girlatschek
4,188,809 A 2/1980 Ishimoto et al.
(Continued)

FOREIGN PATENT DOCUMENTS

CA 2344194 A 3/2000
CN 1179369 A 4/1998
(Continued)

OTHER PUBLICATIONS

English translate (WO03045598A1), retrieved date Sep. 21, 2022.*
(Continued)

*Primary Examiner* — Matthew Katcoff
*Assistant Examiner* — Mohammed S. Alawadi
(74) *Attorney, Agent, or Firm* — Kilpatrick Townsend & Stockton LLP

(57) ABSTRACT

A rolling mill control system and method includes use of sensors located between rolling mill stands to directly measure metal sheet or plate flatness, thickness profile, position, and the camber of the rolls in the mill. A feedback loop control system adjusts or adapts rolling mill control mechanisms to control the rolling process.

18 Claims, 7 Drawing Sheets

Related U.S. Application Data continuation of application No. 62/305,113, filed on Mar. 8, 2016.

(51) Int. Cl.

| | |
|---|---|
| ***B21B 37/16*** | (2006.01) |
| ***B21B 37/28*** | (2006.01) |
| ***B21B 38/02*** | (2006.01) |
| ***B21B 38/04*** | (2006.01) |
| ***B21B 38/10*** | (2006.01) |
| ***B21B 38/12*** | (2006.01) |

(52) U.S. Cl.

CPC ..... *B21B 38/02* (2013.01); *B21B 38/04* (2013.01); *B21B 38/10* (2013.01); *B21B 38/12* (2013.01)

(56) References Cited

U.S. PATENT DOCUMENTS

| | | | | |
|---|---|---|---|---|
| 4,821,544 | A | 4/1989 | Tamler et al. | |
| 4,898,012 | A | 2/1990 | Jones et al. | |
| 5,493,885 | A * | 2/1996 | Nomura | B21B 37/16 72/9.1 |
| 5,806,360 | A | 9/1998 | Dumas | |
| 7,174,758 | B2 | 2/2007 | Tauber et al. | |
| 10,994,317 | B2 | 5/2021 | Fairlie et al. | |
| 2002/0092365 | A1 | 7/2002 | Perenon et al. | |
| 2005/0066698 | A1 | 3/2005 | Tauber et al. | |
| 2006/0137418 | A1* | 6/2006 | Clark | B21D 1/02 72/160 |
| 2014/0150508 | A1 | 6/2014 | Ritter et al. | |
| 2014/0260474 | A1 | 9/2014 | Pralong | |
| 2017/0259313 | A1 | 9/2017 | Fairlie | |

FOREIGN PATENT DOCUMENTS

| | | | | |
|---|---|---|---|---|
| CN | 1323248 | A | 11/2001 | |
| CN | 1887461 | A | 1/2007 | |
| CN | 101039762 | A | 9/2007 | |
| CN | 101623708 | A | 1/2010 | |
| CN | 102489525 | A | 6/2012 | |
| CN | 103357669 | A | 10/2013 | |
| DE | 4203469 | A1 | 8/1993 | |
| DE | 19844305 | A1 | 3/2000 | |
| GB | 1271056 | A | 4/1972 | |
| JP | 6087911 | A | 5/1985 | |
| JP | S62293105 | A | 12/1987 | |
| JP | H08215728 | A | 8/1996 | |
| JP | H10216815 | A | 8/1998 | |
| JP | H11277122 | A | 10/1999 | |
| JP | 2001219209 | A | 8/2001 | |
| JP | 2003305511 | A | 10/2003 | |
| JP | 2008515647 | A | 5/2008 | |
| KR | 20050032722 | A | 4/2005 | |
| WO | WO-03045598 | A1 * | 6/2003 | B21B 37/38 |
| WO | 2006042606 | A1 | 4/2006 | |
| WO | 2017156122 | | 9/2017 | |

OTHER PUBLICATIONS

U.S. Appl. No. 15/453,429 , Non-Final Office Action, dated Nov. 22, 2019, 14 pages.
U.S. Appl. No. 15/453,429 , Final Office Action, dated Mar. 16, 2020, 16 pages.
U.S. Appl. No. 15/453,429 , Advisory Action, dated May 19, 2020, 4 pages.
U.S. Appl. No. 15/453,429 , Non-Final Office Action, dated Jun. 22, 2020, 27 pages.
U.S. Appl. No. 15/453,429 , Final Office Action, dated Sep. 29, 2020, 36 pages.
U.S. Appl. No. 15/453,429 , Notice of Allowance, dated Jan. 7, 2021, 8 pages.
Bösenberg et al., "Heavy Machinery", Taylor Rolling Mill, Jan. 31, 1974, pp. 93-98, along with a partial machine translation, 11 pages.
Canadian Patent Application No. 3016699 , Office Action dated Feb. 26, 2020, 4 pages.
Canadian Patent Application No. 3016699 , Office Action dated Jul. 9, 2019, 4 pages.
Canadian Patent Application No. 3016699 , Office Action dated Aug. 26, 2020, 4 pages.
Chinese Patent Application No. 201780016131.0 , Office Action dated Mar. 2, 2020, 10 pages.
Chinese Patent Application No. 201780016131.0 , Office Action dated Apr. 30, 2019, 21 pages.
Chinese Patent Application No. 201780016131.0 , Office Action dated Sep. 27, 2019, 21 pages.
European Patent Application No. 17712359.3 , Office Action dated Jan. 28, 2020, 3 pages.
European Patent Application No. 17712359.3 , Office Action, dated Aug. 8, 2019, 4 pages.
Indian Patent Application No. 201817033692 , First Examination Report dated Aug. 26, 2020, 7 pages.
Japanese Patent Application No. 2018-566197 , Office Action dated Sep. 1, 2020, 7 pages.
Japanese Patent Application No. Application No. JP2018-566197 , Office Action dated Oct. 15, 2019, 8 pages.
Korean Patent Application No. 10-2018-7028656 , Office Action dated Jan. 15, 2020, 11 pages.
Korean Patent Application No. 10-2018-7028656 , Office Action dated Jun. 14, 2020, 4 pages.
International Patent Application No. PCT/US2017/021353 , International Search Report and Written Opinion dated May 17, 2017, 10 pages.
Qin et al., "Thermal Behavior and Mechanical Behavior of Continuous Casting Equipment", Metallurgical Industry Press, Apr. 30, 2013, along with a partial machine translation, 7 pages.
Xu et al., "Cold-Rolled Narrow Strip Steel Production", Northeastern University of Technology Press, Aug. 31, 1992, along with a partial machine translation, 7 pages.
Canadian Application No. 3,123,561, "Office Action", dated Oct. 13, 2022, 5 pages.
Brazilian Application No. BR112018067928-3, "Notice of Allowance", dated Jul. 11, 2023, 2 pages.
Brazilian Application No. BR112018067928-3, "Office Action", dated Mar. 28, 2023, 5 pages.

* cited by examiner

METHOD AND APPARATUS FOR CONTROLLING METAL STRIP PROFILE DURING ROLLING WITH DIRECT MEASUREMENT OF PROCESS PARAMETERS

CROSS REFERENCE TO RELATED APPLICATIONS

This application is a continuation of U.S. patent application Ser. No. 15/453,429, filed on Mar. 8, 2017, which claims the benefit of U.S. Provisional Patent Application No. 62/305,113, filed on Mar. 8, 2016, the contents of which are incorporated by reference in their entirety. This application is also related to U.S. patent application Ser. No. 14/203,695 filed on Mar. 11, 2014, which is hereby incorporated by reference in its entirety.

TECHNICAL FIELD

The present application relates to control systems and methods for measuring and controlling the thickness profile and flatness of a metal strip in a multi-stand hot rolling mill.

BACKGROUND

Hot rolling is a metal forming process in which thick stock, strips, or plate are passed through a pair of rolls to reduce the thickness of the stock, strips, or plate. During processing, the rolls of the mill and the metal sheet or plate passing through the rolls heat up due to the pressure and friction of rolling, metal deformation, and/or because the metal sheet or plate entering the rolling mill is hot. The resulting heat causes expansion of the rolling mill rolls, which affects the thickness profile, flatness and quality of the processed metal sheet or plate.

A number of mechanisms and methods are employed to compensate for the distortion of the work rolls in a rolling mill due to temperature and pressure. For example, rolling mills may be equipped with various systems to heat and cool the work rolls and/or backup rolls of a mill to achieve the required thermal camber. Many rolling mills are also equipped with jacking mechanisms to apply pressure to work rolls chocks and/or backup rolls chocks to bend the rolls during processing to produce metal sheet or plate with improved flatness and thickness profile consistency. Work rolls and/or backup rolls may be ground with distorted profiles that are intentionally not perfectly cylindrical to compensate for the distortion that occurs during rolling. Other, more expensive systems, such as deformable backup rolls, which can dynamically change the roll camber, or continuous variable crown (CVC) work and/or intermediate rolls that may shift along their rotation axis to change the geometry of the work roll gap may be used to compensate for changes to work roll camber during use.

The above mentioned rolling mill control mechanisms only provide adequate compensation for work roll thermal camber, and the resultant flatness and thickness profile consistency of the processed metal sheet or plate, if an operator or controller has adequate information on the conditions of the work rolls, such as operating conditions like rolling load and bending forces, the processed metal sheet or plate, or any combination thereof. Today, rolling mills are operated with a limited number of sensors and thermal models to attempt to predict rolling mill conditions and adjust them to achieve the best possible flatness and consistency of thickness profile across the face of the metal sheet or plate. However, models combined with measurements of the flatness and thickness profile of the metal sheet or plate as it enters or leaves a multi-stand rolling mill do not provide adequate information to allow the rolling mill and its associated control mechanisms to fully compensate for work roll thermal camber in real time. Specifically, thermal models are often inaccurate and may not represent actual rolling mill conditions. Measurements of the flatness and thickness profile of the metal sheet or plate as it exits a multi-stand rolling mill have too much delay to quickly and effectively adjust rolling mill control mechanisms in response to changing process and material parameters. Furthermore, in a multi-stand rolling mill, these measurements alone do not indicate which rolling stands require adjustment to achieve the desired thickness profile.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Disclosed are systems and methods for using sensors located at or between successive stands of a multi-stand hot or hot finishing mill, or with a hot reversing mill (with one or more stands for back and forth passes), to measure the thermal camber of the rolls, flatness, and/or thickness profile of the strip and calculate the crown and/or wedge across the width of a metal sheet or plate that is being rolled in the rolling mill to control thickness profile, flatness and/or strip position within a target tolerance. The use of sensors located between rolling mill stands to directly measure metal sheet or plate flatness, thickness profile, position, and/or the camber of the rolls in the mill may be used with a feedback loop control system to adjust or adapt rolling mill control mechanisms quickly to produce metal sheet or plate with improved flatness and thickness profile consistency.

Interstand measurement of metal sheet or plate allows a control system to measure metal sheet or plate flatness, thickness profile, and/or position in real time so that a feedback loop may be used to control the rolling mill control mechanisms, such as, but not limited to, deformable backup rolls, bending jacks, any other profile actuator, coolant sprays, continuously variable crown intermediate or work rolls, rolling load, metal strip tension, or any other mechanism that may influence rolling mill performance and/or the properties of the rolled strip or plate. Adjustments to the rolling mill control mechanisms for the first stand may be used to achieve a target thickness profile while having a small effect on flatness. This thickness profile may then be propagated to downstream stands by ensuring that the roll gap geometry under load matches the thickness profile and ensuring uniform relative reductions in thickness at all points across the metal strip. This is done by measuring the thermal camber of the roll directly and using the appropriate actuators, such as roll jacks and/or sprays to control the roll gap. To ensure that the desired roll gap can be achieved, the thermal camber of the rolls is controlled by selective heating and cooling of the rolls. Alternatively, each successive stand in a rolling mill may include a sensor to measure metal sheet or plate flatness and thickness profile for multiple feedback loops in succession or to provide downstream measurements of strip thickness profile for upstream propagation of adjustments to individual stands of the hot rolling mill.

BRIEF DESCRIPTION OF THE DRAWINGS

Illustrative examples of the present disclosure are described in detail below with reference to the following drawing figures.

DETAILED DESCRIPTION

Figure 1:
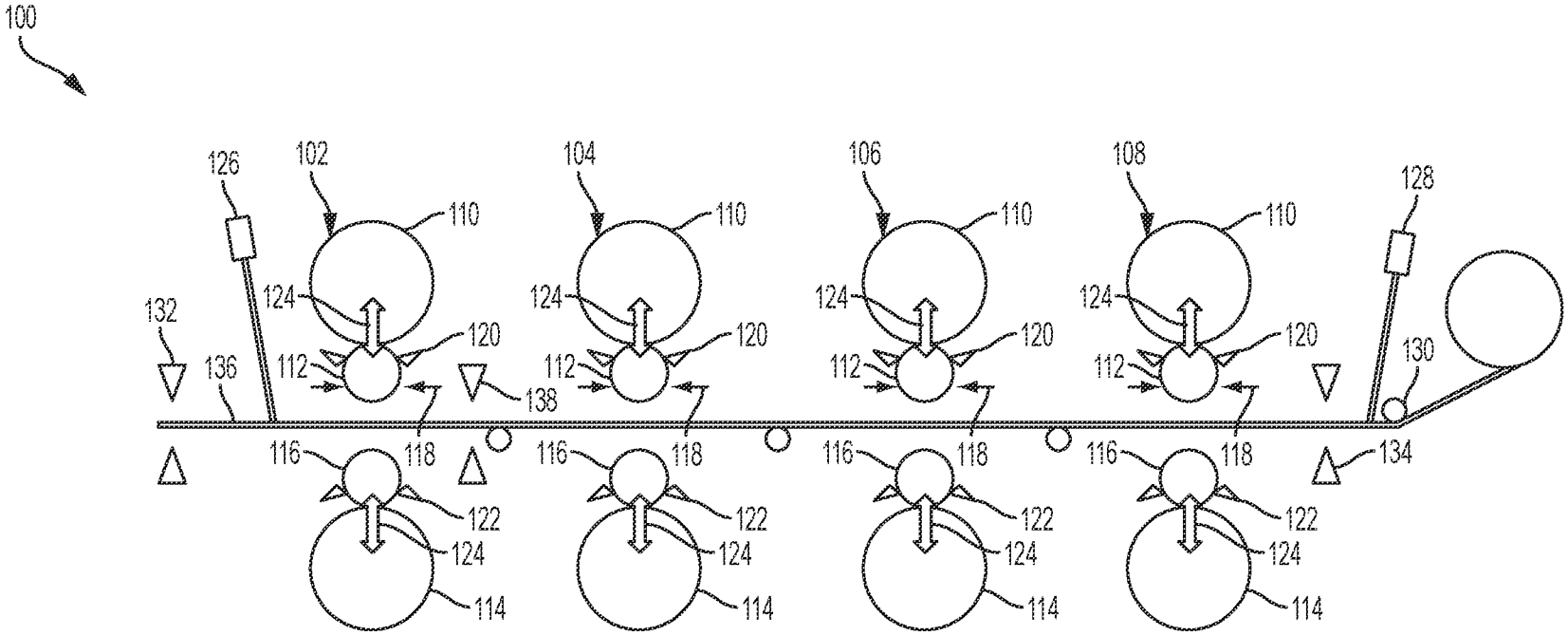
FIG. 1 is a schematic side view of a multi-stand hot rolling mill with roll camber and interstand metal strip property and position sensors according to an example.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

As used herein, thickness generally refers to a point measurement of the thickness of a metal strip taken perpendicular to the face of the strip, often, but not necessarily, at the centerline of the metal strip. Thickness profile or profile generally refers to the aggregation of thickness measurements taken across a particular cross section of the metal strip perpendicular to the rolling direction. The thickness profile may be directly measured by continuous measurements of the thickness across the face of the metal strip, such as with a traversing or oscillating thickness sensor, or by measuring the thickness at multiple locations across a particular cross section of the strip and approximating the profile with a mathematical model. The thickness profile may be approximated by a second or higher order polynomial, though other mathematical models may also be used. Thickness and/or thickness profile may be expressed in units of length, generally mils, millimeters, or microns. Crown and wedge are parameters of the measured thickness profile. Crown generally describes the difference in thickness between the centerline of the metal strip and the average of the two edge thicknesses. Wedge generally refers to the thickness difference between the two strip edges of the metal strip. Crown and wedge are generally expressed as a percentage of the polynomial centerline thickness. Generally, flatness is a measure of the buckling of the metal strip when it is not under tension due to unequal elongation at different points across the metal strip as it is passed through the rollers and experiences a reduction in thickness. Roll camber generally refers to the shape and/or deviation from perfectly cylindrical rolls in a rolling mill. Camber may describe the shape of a work roll that directly contacts the metal strip, or any of the other rolls that are present in the rolling mill and is generally expressed in units of length.

Throughout this specification, references to the properties, parameters, or the like of the metal strip may include, but are not limited to, thickness, thickness profile, flatness, temperature, electrical conductivity, width, position, angles in the rolling direction, angles in the lateral direction, total tension outside the roll gap, and/or differential tension outside the roll gap. These properties and parameters may be measured by a variety of sensors, including, in certain cases, one or more of the metal strip property and position sensors described below. The rolling mill and/or any individual rolling mill stands may also include one or more profile actuators and/or mill control mechanisms. For example, a rolling mill or rolling stand may include profile actuators such as bending jacks and/or other mechanisms to apply a bending force to the work and/or backup rolls, thermal crown actuators, which may include roll heating and/or roll cooling via hot or cold sprays, induction heaters or any other thermal management mechanism, continuous variable crown (CVC) intermediate and/or work rolls, deformable backup rolls, roll tilting, and/or roll pair crossing. In some cases, a rolling mill and/or rolling stand may also have one or more setup or production parameters that may be taken into account during rolling, startup, shut down, transient behavior, and may be measured through the use of one or more sensors, such as the metal strip property and position sensors described below or by dedicated sensors used for a particular purpose. These setup or production parameters may include, but are not limited to, thickness reduction, work roll position, differential rolling load, rolling speed, speed differences between individual stands of the rolling mill, roll torque, and/or differential strip cooling.

A rolling mill and/or individual rolling stands, as described throughout this specification, may have any number of additional sensors to monitor the rolling mill and/or rolling stand processing conditions. In some cases, sensors in the rolling mill and/or individual rolling stands may monitor rolling load, bending forces, roll and metal strip speed, roll torque and/or work roll position. Furthermore, sensors may monitor the roll camber of the work and/or backup rolls with ultrasonic, infrared, touch and/or other suitable sensors. In certain cases, a rolling mill and/or individual rolling stand may also include infrared, ultrasonic, touch, laser and/or other suitable sensors for directly measuring the roll gap geometry. Further, the roll gap geometry can also be determined indirectly by calculating it based on roll camber measurements, and/or the change of thickness profile and flatness between the incoming and outgoing strip together with other rolling parameters such as, but not limited to, rolling load, bending forces, strip tensions and metal sheet properties. Any of the above mentioned sensors, parameters and/or operating conditions may be used in the control systems and methods described throughout this specification. One or more of these sensors, parameters and/or operating conditions can be monitored and/or adjusted to maintain or change the roll gap geometry of one or more rolling stands of a rolling mill to produce rolled metal sheet or plate with properties or parameters that are within a desired range or tolerance.

Certain aspects and features of the present disclosure relate to the use of interstand metal strip property and position sensors in multi-stand hot rolling mills to process aluminum sheet or plate. The use of metal strip property and position sensors to measure the strip thickness profile between individual stands of a hot rolling mill offers advantages and opportunities for enhanced control methods, improved efficiency, and higher product quality than is available with traditional control systems that only incorporate sensors before and after the first and final rolling mill stands, respectively. Interstand measurement of the thickness profile and/or other properties or parameters of the metal sheet or plate, often referred to as the strip, along with measurement of roll thermal camber, roll gap geometry and/or monitoring of other rolling mill process parameters, provides information about the current operating conditions of the hot rolling mill and allows an operator or control system to compensate for constant or dynamic variances or irregularities. Interstand measurements of the metal strip thickness profile and/or other properties or parameters such as roll thermal camber and roll gap geometry and/or mill process parameter measurements may be used to more accurately control the rolling mill, to determine which rolling stand may be causing excessive variance, and to replace or support setup tables and mathematical models with direct measurement and feedback loop and/or other, more advanced controls. Improved control over the rolling mill and individual rolling stands allows for production of higher quality products and reduced waste because the rolling mill and rolling stands may react faster to out of specification sheet to minimize the amount of unacceptable product and/or adjust subsequent rolling stands to compensate with no or reduced loss of material. Improved measurement of rolling mill conditions may also be used to improve adjacent processes by feeding information from the hot rolling mill to, for example, a reversing mill.

FIG. 1 is a schematic side view of a multi-stand hot rolling mill 100 that incorporates a number of sensors to monitor rolling mill 100 operating conditions and control mechanisms to adjust rolling mill 100 parameters to compensate for changing process conditions and maintain acceptable product quality specifications. The rolling mill 100 comprises a first rolling stand 102, a second rolling stand 104, a third rolling stand 106, and a fourth rolling stand 108. However, the rolling mill 100 may incorporate as few or as many rolling stands as is necessary for the particular material, final product specifications, and/or processing plant spacing and production considerations. Each rolling stand 102, 104, 106, 108 includes an upper backup roll 110 that provides support to an upper work roll 112. Similarly, each rolling stand 102, 104, 106, 108 also includes a lower backup roll 114 to provide support to a lower work roll 116. In some cases, additional or no backup rolls are used. A metal strip 136 passes between the upper and lower work rolls 112, 116 of the rolling stands 102, 104, 106, 108 from left to right in FIG. 1.

The rolling mill 100 also incorporates a number of sensors to provide information regarding the operating conditions of the rolling mill 100 and the condition of the metal strip 136 as it enters, passes through, and exits the rolling mill 100. In certain cases, sensors may be used to directly measure the operating conditions of the rolling mill 100 and its individual rolling stands 102, 104, 106, 108 and work rolls 112, 116. As shown in FIG. 1, work roll camber measurement sensors 118 may be used to determine the amount of camber or distortion in the upper work rolls 112. In some cases, the work roll camber measurement sensors 118, which may be ultrasonic sensors, infrared sensors, laser based roll gap geometry sensors, touch sensors, or any type of sensor that is suitable to determine the thermal camber of the work rolls, may be used on the upper work rolls 112, lower work rolls 116, both upper and lower work rolls 112, 116, or any combination or subset thereof. However, in many applications, measurement of the thermal camber of only the upper work rolls 112 or lower work rolls 116 may be sufficient to determine the operating conditions and roll gap geometry for that particular rolling stand 102, 104, 106, 108. Additional sensors to measure rolling mill 100 operating conditions may include, but are not limited to, work roll temperature sensors, work roll contact pressure sensors, or any other sensor that is necessary for the particular application or rolling mill 100 design or apparatus.

The rolling mill 100 and any associated control system may also include sensors to directly measure metal strip 136 properties or conditions. For example, an entrance temperature sensor 126 may be used to measure the temperature of the metal strip 136 prior to its entrance into the first rolling stand 102. An exit temperature sensor 128 may also be used to measure the temperature of the metal strip 136 as it exits the final rolling stand 108 of the rolling mill 100. In certain cases, it may be possible to measure the temperature of the metal strip 136 between rolling stands 102, 104, 106, 108 based on the change in conductivity when the temperature and conductivity of the metal strip 136 are known prior to entering the first rolling stand 102. In some cases, the temperature of the metal strip 136 may be measured at multiple points, or by a scanning and/or oscillating sensor, to provide a temperature profile across the metal strip 136 and compensate for differential expansion due to temperature gradients caused by varying levels of force, reductions in thickness, or other variations in the metal rolling process. The rolling mill 100 may also include sensors to determine the centerline thickness and thickness profile of the metal strip 136 and calculate the corresponding crown and/or wedge values for the metal strip 136 as it enters the rolling mill 100, during processing, and as it exits the final rolling stand 108. For example, one or more incoming metal strip property and position sensors 132 may be positioned to measure the thickness, thickness profile, conductivity and/or any other properties or parameters of the metal strip 136 before it enters the first rolling stand 102. Similarly, one or more exit metal strip property and position sensors 134 may be positioned to measure the thickness, thickness profile and/or any other properties or parameters of the metal strip 136 as it exits the final rolling stand 108. A flatness roll 130 may be positioned after the final rolling stand 108 to measure the consistency of the tension stresses across the width of the metal strip 136 to determine the tendency for strip buckling that is present in the metal strip 136 after passing through the rolling mill 100. In certain cases, a flatness roll 130 may be positioned between the last and second-to-last stands, here the third rolling stand 106 and fourth rolling stand 108, to measure the tension stresses across the width of the metal strip 136 to indicate any variations or discrepancies in the work roll 112, 116 gap geometry as the metal strip 136 passes through the rolling mill 100. In certain cases, any tendency for buckling may be measured using one or more of the incoming metal strip property and position sensors 132, exit metal strip property and position sensors 134, and/or interstand metal strip property and position sensors 138 to measure the strip angles in the rolling and lateral directions.

In addition, one or more interstand metal strip property and position sensors 138 may also be positioned between the first rolling stand 102 and the second rolling stand 104. The one or more interstand metal strip property and position sensors 138 provide information to a control system and/or operator regarding the thickness profile and/or any other properties or parameters of the metal strip 136 as it exits the first rolling stand 102 and before it enters the second rolling stand 104. In some cases, the one or more interstand metal strip property and position sensors 138 may be positioned between other rolling stands 102, 104, 106, 108 or additional interstand metal strip property and position sensors 138 may be added between subsequent rolling stands 104, 106, 108 to provide more information on the processing of the metal strip 136 as it passes between individual rolling stands 102, 104, 106, 108. This information provides much faster feedback to the control system and/or operator regarding the performance of the rolling mill 100 and the conditions of the metal strip 136, including any deformities, abnormalities, and/or dimensions that are not within desired tolerances or specifications. As a result, the operator and/or control system may adjust one or more of any available rolling mill control mechanisms of the first rolling stand 102 and/or any subsequent rolling stand 104, 106, 108 to compensate for metal strip 136 thickness profile, crown, wedge, thickness tolerance, flatness and/or other irregularities while the metal strip 136 is being processed in the rolling mill 100 so that the metal strip 136 will exit the rolling mill 100 with an acceptable thickness profile and/or levels of wedge, crown, flatness, thickness variation, or any other desired characteristics or metrics for the metal strip 136. The reduced delay between processing and measurement gives more accurate, real-time or nearly real-time control over the rolling mill 100 and its individual rolling stands 102, 104, 106, 108. Direct measurement of the metal strip 136 with one or more interstand metal strip property and position sensors 138 and/or direct measurement of work roll 112, 116 thermal camber reduces or eliminates the need for mathematical or computer modeling or use of setup tables of the rolling mill 100, either during steady state, acceleration, deceleration, or startup procedures. Rather, control of the rolling mill 100 in any steady state or transitional condition may be achieved with feedback or other, more advanced controls in combination with real time information from one or more of the incoming metal strip property and position sensors 132, exit metal strip property and position sensors 134, interstand metal strip property and position sensors 138, work roll camber measurement sensors 118, and/or any other sensors for determining the status of the metal strip 136, rolling mill 100, or any individual rolling stand 102, 104, 106, 108. Due to the reduced delay in measuring metal strip 136 properties and improved methods of control, the rolling mill 100 may provide improved product quality and higher efficiency because a greater portion of the metal strip 136 will achieve acceptable product tolerances and specifications.

Still referring to FIG. 1, the rolling mill 100 may also include a number of control mechanisms designed to alter or adjust the operating conditions of the rolling mill 100 and/or any individual rolling stands 102, 104, 106, 108. The rolling mill 100 may include work roll 112, 116 thermal crown control via mechanisms such as upper sprays 120 and/or lower sprays 122 to apply heated or cooled liquid to the upper and lower work rolls 112, 116, respectively. If desired, forces may be applied to distort or bend the upper and/or lower work roll 112, 116 during processing of the metal strip 136 by jacking the work rolls (through the bending system) or tilting the stack (through the roll tilt system), or other suitable mechanisms. Additional or alternative control mechanisms may also be employed by a rolling mill 100 including, but not limited to, induction heaters, differential strip cooling, deformable backup and/or work rolls, and/or continuous variable crown (CVC) intermediate and/or work rolls. The control mechanisms may be integrated with the control system, or may work directly with the one or more interstand strip property and position sensors 138 and other associated sensors described above to adjust the rolling mill 100 so as to process the metal strip 136 within the desired tolerances or specifications.

For the thickness range of a metal strip 136 in a multi-stand hot rolling mill 100, the amount of crown change available for any particular rolling stand 102, 104, 106, 108 without affecting the flatness of the metal strip 136 may be limited. To maintain control of the metal strip 136 as it passes through the rolling mill 100, and to facilitate subsequent coiling of the metal strip 136, a thickness profile with a small positive crown (i.e. a thicker center) may be preferred. For aluminum, this crown is generally in the range of 0.1-0.9%, preferably 0.3-0.9%, or more preferably 0.3-0.5% or 0.5-0.9% of the metal strip 136 thickness and is parabolic in shape. The above-mentioned control mechanisms for the rolling mill 100 may be used to alter the roll gap geometry and/or the relative spacing between the work rolls 112, 116 through which the metal passes. To reduce crown, the roll gap between the work rolls 112, 116 is reduced in the center relative to the edges. Similarly, to increase the crown, the roll gap between the work rolls 112, 116 is increased in the center relative to the edges. Changes to the roll gap between the work rolls 112, 116 will cause the material of the metal strip 136 to flow in two directions, changing the thickness profile, crown, and wedge of the metal strip 136. The material of the metal strip 136 will flow in a lateral direction between the center and edges of the metal strip 136. The material of the metal strip 136 will also flow in a longitudinal direction causing a change in the elongation of the metal strip 136 in the rolling direction relative to other points across the strip, resulting in a change to the flatness of the metal strip 136.

At relatively high thicknesses, the difference between the roll gap geometry and metal strip 136 thickness profile is generally taken up by lateral flow rather than longitudinal flow, resulting in changes to the crown of the metal strip 136 as opposed to flatness. As the metal strip 136 becomes thinner, for the same relative discrepancy between the thickness profile of the metal strip 136 and the roll gap geometry, the differential elongation of the metal strip 136 increases relative to the lateral flow, causing changes in the flatness of the metal strip 136 rather than changes in the crown. For these reasons, it may be advantageous to correct the thickness profile of the metal strip 136 in the first rolling stand 102 and control the roll gap geometry of the subsequent rolling stands 104, 106, 108, which are under load when the metal strip 136 is in the rolling mill 100, to match the thickness profile of the metal strip 136 such that the relative thickness reduction is the same across the width of the metal strip 136 to avoid changing the crown or flatness of the metal strip 136. With measurement of the thermal camber of the work rolls 112, 116 and/or backup rolls 110, 114 and data on the rolling load, it is straightforward to calculate the resulting changes in roll gap and geometry due to roll deflection and flattening under load. The control mechanisms of the rolling mill 100 may then be used to achieve the desired roll gap and roll gap geometry.

The objectives of controlling and maintaining a target thickness profile may be achieved using two types of control loops: a fast loop at one or more rolling stands 102, 104, 106, 108 that changes roll gap geometry control mechanisms while the mill is under load and the metal strip 136 is rolled, and a slow loop that acts continuously to control longer term changes in the thickness profile, crown, and/or wedge between rolling metal strips 136 and while the metal strip 136 is rolled. The fast loop controls the measured thickness profile and flatness of the metal strip 136 at the exit of one or more rolling stands 102, 104, 106, 108 to within an acceptable tolerance of a target thickness profile and flatness, and reduce thickness profile variation in the metal strip 136 resulting from material variation and/or transient effects due to acceleration of the rolling mill 100 or other transient behavior. The slower loop adjusts the thermal camber of the work rolls 112, 116 and other control mechanisms of one or more of the rolling stands 102, 104, 106, 108 such that the available range of bending force 124 may be optimized for the fast control loops. The resulting performance of the rolling mill 100 may then minimize any errors in the thickness profile and flatness of the metal strip 136.

Because the transfer functions for the control mechanisms of the rolling mill 100 are well-known, and the thermal camber of the rolls 112, 116 is controlled, these control mechanisms may be adjusted under load to match roll gap geometry of any downstream rolling stands to the measured thickness profile of the metal strip 136 leaving any upstream rolling stand, such that changes in thickness profile and flatness are minimized. Since the thickness profile of the metal strip 136 may match the roll gap geometry of any particular rolling stand 102, 104, 106, 108, each point across the metal strip 136 may have the same relative reduction in thickness, such that there is no change in the relative thickness profile of the metal strip 136. In this way, the desired thickness profile, crown and/or wedge that is achieved after the first rolling stand 102 is maintained through subsequent rolling stands 104, 106, 108. The result is relatively little differential deformation across the metal strip 136 and relatively minimal differential elongation and change in flatness. To ensure that the flatness targets are met, a flatness roll 130, or any other flatness measurement sensing device, such as the use of one or more of the metal strip property and position sensors 132, 134, 138 measuring the position and angles of the metal strip 136 in the rolling and lateral directions, may be added after the last rolling stand 108 or any of the other rolling stands 102, 104, 106 so that flatness errors may be fed back to the control system to adjust work roll 112, 116 heating, cooling, bending, roll tilting, and/or any other control mechanisms available to the rolling mill 100 that may influence the roll gap geometry of the rolling stands 102, 104, 106, 108. The feedback from the one or more interstand strip property and position sensors 138 at the exit of a rolling stand 102, 104, 106 is used to adjust any available control mechanisms in each subsequent rolling stand 104, 106, 108 using the fast control loop. In the case of a coil or product change, the slow control loop may adjust the work roll 112, 116 thermal camber and/or any other control mechanisms of the rolling mill 100 or any individual rolling stand 102, 104, 106, 108 such that unwanted distortions of the desired thickness profile and flatness of the metal strip 136 are minimized during the transition phase.

Figure 2:
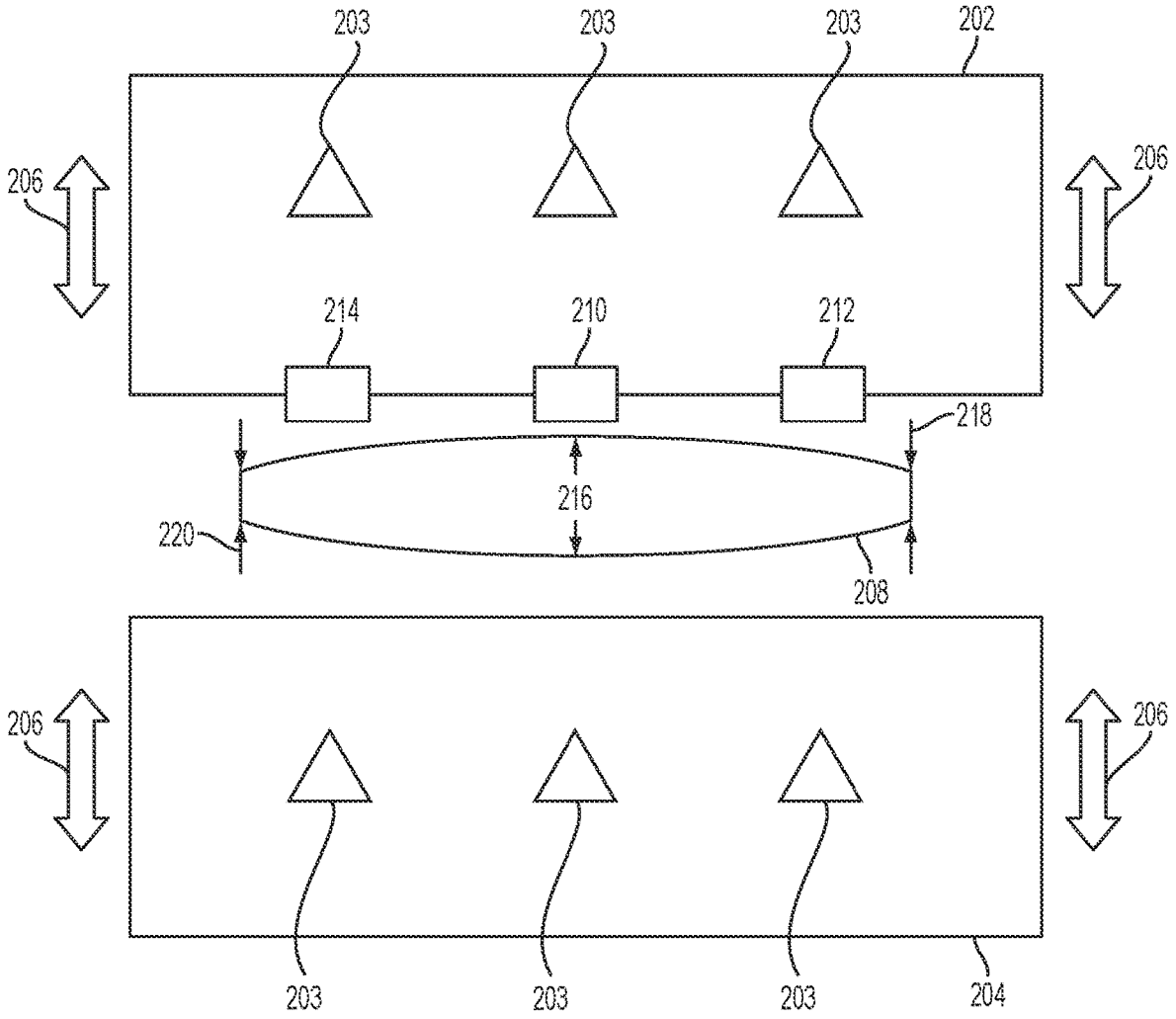
FIG. 2 is a schematic end view of hot rolling mill stand with multiple metal strip property and position sensors according to an example.

FIG. 2 is a simplified schematic end view of the exit side of a hot rolling mill stand with multiple work roll camber measurement sensors 203 and multiple interstand metal strip property and position sensors 210, 212, 214. The rolling mill stand includes an upper work roll 202 and a lower work roll 204. The upper and lower work rolls 202, 204 may have a bending force 206 applied by a bending or jacking system (not shown) and/or a roll tilting system (not shown) that may, in combination with any work roll camber, influence the roll gap geometry between the upper and lower work rolls 202, 204. A metal strip 208 passes through the upper and lower work rolls 202, 204 in the direction of the viewer during processing.

At the exit of the rolling mill stand, a central interstand metal strip property and position sensor 210, right interstand metal strip property and position sensor 212, and left interstand metal strip property and position sensor 214 are positioned to read the centerline thickness, thickness profile, flatness and/or any other property or parameter of the metal strip 208 after it has passed through the upper and lower work rolls 202, 204 and before it enters a subsequent stand for further rolling. As shown, the rolling mill may include, before or after any individual stand, any suitable number of interstand metal strip property and position sensors, such as multiple interstand metal strip property and position sensors 210, 212, 214, to measure at different points, zones or areas across the face of the metal strip 208. In certain cases, a single interstand metal strip property and position sensor that quickly scans the face of the metal strip 208 or one or more oscillating interstand metal strip property and position sensors that may be capable of measuring different points along the face of the metal strip 208 may be used. In some cases, the interstand metal strip property and position sensors 210, 212, 214 may be single-sided sensors, double-sided sensors, or any combination thereof. Furthermore, the interstand metal strip property and position sensors 210, 212, 214 may be any type of sensor including, but not limited to, induction sensors, eddy current sensors, x-ray sensors, or any other type of sensor that is capable of measuring the thickness, thickness profile, conductivity, strip angles, temperature and/or any other desirable parameter or property of the metal strip 208. The type of interstand strip property and position sensor chosen for a particular application may be based on an evaluation of factors such as the type of metal being measured, the throughput speed of the metal strip 208, the temperature of the metal strip 208 or environment surrounding the metal strip 208, any cooling or heating fluids, or any other environmental considerations. The interstand metal strip property and position sensors 210, 212, 214 should be selected to provide accurate results and survivability in the conditions of the application.

Still referring to FIG. 2, the metal strip 208 includes a centerline thickness 216, right thickness 218, and a left thickness 220. The measurements taken by the central strip property and position sensor 210, the right strip property and position sensor 212 and the left strip property and position sensor 214 indicate the thickness of the metal strip 208 at particular points along the cross section or face of the metal strip 208. In some cases, a greater or lesser number of thickness measurements may be taken across the width of the metal strip 208. Furthermore, multiple thickness measurements across the width of the metal strip 208 may not be evenly distributed and can be located at any position across the face of the metal strip 208. Said differently and by way of example, in certain cases a relatively large number of thickness measurements may be clustered in an area that is particularly problematic or critical to the performance of the metal strip 208, while other areas may include relatively fewer thickness measurements. As another non-limiting example, in some cases, the right strip property and position sensor 212 and the left strip property and position sensor 214 can be located at various distances from edges of the metal strip 208 such that the sensors 212, 214 measure the metal strip 208 at a distance from the edges of the metal strip 208, respectively. In other examples, several rows of sensors may be provided across the width. For example, in some cases, one sensor row may be at the exit of the first stand, another sensor row may be a predetermined distance away from the first stand, and yet another sensor row may be at the entry of the second stand. Various other configurations of sensors may be used.

As the metal strip 208 passes through the rolling stands of the mill, the interstand metal strip property and position sensors 210, 212, 214 will measure, among other properties of the metal strip 208, the thicknesses 216, 218, 220. Because the interstand metal strip property and position sensors 210, 212, 214 are positioned relative to the face of the metal strip 208 and the metal strip 208 moves past them, multiple measurements by the interstand metal strip property and position sensors 210, 212, 214 may be compiled to provide a three-dimensional thickness profile and flatness function that describes the thickness profile and flatness variations for a length of the metal strip 208, and that may be used, among other things, to control the three-dimensional flatness and thickness profile of the metal strip 208 and/or to continuously adjust the rolling stands of the mill to correct or compensate for any portions of the metal strip 208 that do not have acceptable flatness, thickness profile, or other strip properties as it passes through the rolling mill. For example, if a first portion of the metal strip 208 has a different profile than a second, later portion, the rolling mill and any associated control system may use the different thickness profile measurements along the length of the metal strip 208 to alter subsequent rolling stands to account for these differences as the metal strip 208 progresses through the rolling mill.

The thickness measurements 216, 218, 220 may also be used to calculate other properties of the metal strip 208 as it passes through the rolling mill. As shown in FIG. 2, the metal strip 208 may deviate from an ideal rectangular profile with differing thickness measurements 216, 218, 220 across its width (deviations enlarged to show detail). The thickness measurements 216, 218, 220 taken by the interstand metal strip property and position sensors 210, 212, 214 may be used to calculate the curvature or crown of the metal strip 208 by determining the differences across the face of the metal strip 208 relative to the centerline thickness 216. Also, the difference in the right thickness 218 and left thickness 220 may be used to calculate any wedge or sloped profile of the metal strip 208 during processing. These values may then be compared to desired or acceptable ranges for thickness profile, crown and/or wedge to determine whether adjustments to the rolling mill or individual rolling stands are necessary. Should adjustment be necessary, any of the above described control mechanisms of FIG. 1 may be used to control the thickness profile, centerline thickness, flatness and/or any other properties or parameters of the metal strip 208. Similarly, any of the above mentioned sensors of FIG. 1 may be incorporated into the control system to provide further information on which control mechanisms require adjustment and/or the extent of those adjustments.

The multiple interstand strip property and position sensors 210, 212, 214 may also be used to determine the relative location and contour of the metal strip 208 as it passes through the work rolls 202, 204. For example, the strip property and position sensors 210, 212, 214 may be used to measure the lateral positions of the edges, the strip height position relative to a pass line, and/or the surface angles of the metal strip 208, among others. These measurements may then be used to calculate or determine the three-dimensional position, form and/or manifested off-flatness of the metal strip 208. These values may then be used for steering the metal strip 208 to maintain its position at the centerline of the work rolls 202, 204 and control the roll gap geometry to avoid errors in the thickness profile and/or flatness of the metal strip 208. Maintaining the metal strip 208 at the centerline of the work rolls 202, 204 improves the accuracy of measurements of the thickness profile and likelihood of a symmetric thickness profile. The strip property and position sensors 210, 212, 214 may also be used to measure the temperature of the metal strip 208 by detecting the conductivity of the metal strip 208, or the changes in conductivity of the metal strip 208 from when it entered the rolling mill to its current position.

Figure 3:
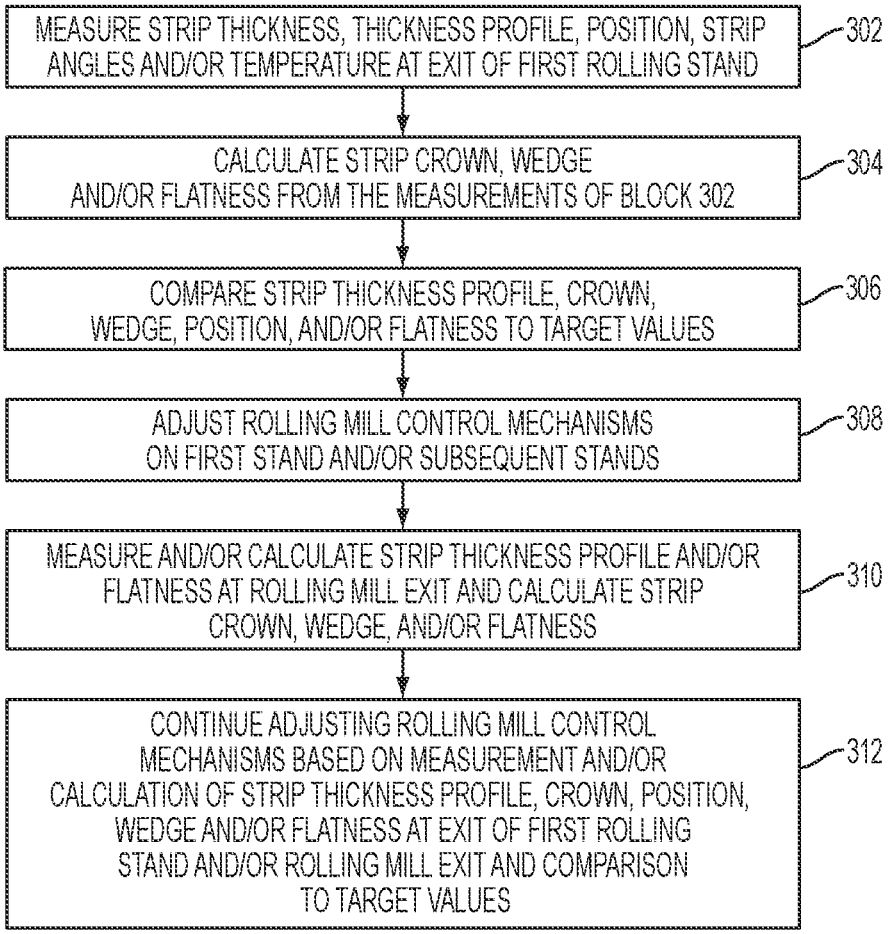
FIG. 3 is an exemplary method for controlling a hot rolling mill with roll camber and interstand metal strip property and position sensors according to an example.

FIG. 3 is an exemplary method for controlling a hot rolling mill incorporating interstand metal strip property and position sensors such as, but not limited to, sensors 138, 210, 212, and/or 214. During the operation of a rolling mill, the interstand metal strip property and position sensors may record the position, strip angles, flatness, temperature, point thicknesses and/or the thickness profile of the metal strip at block 302. Depending on the particular strip property and position sensors used and their capabilities, the thickness profile may be either directly measured or it may be calculated based on individual point thickness measurements of the metal strip. These measurements may then be used to calculate the metal strip thickness profile, crown, wedge and/or flatness at block 304. The calculated values of the metal strip thickness profile, crown, wedge and/or flatness, and the directly measured values for the strip thickness and/or thickness profile and/or position, may then be compared to desired or target values and/or desired or target values incorporating an allowable or acceptable tolerance range at block 306. Based on the measured thicknesses and/or thickness profile and the calculated thickness profile, crown, wedge, flatness and/or any other property or parameter values, a control system and/or operator may adjust the first stand or subsequent stands to compensate for or correct any measurements that are not within a desired or target range at block 308. In some cases, it may be preferable to adjust the first stand, one or more subsequent stands, or both. This determination may be made based on the type of error, whether it is a relatively constant error or a fluctuating error, and the amount of the discrepancy between the desired values and the measured thicknesses and/or thickness profile and/or the calculated metal strip thickness profile, crown, wedge and/or flatness. Furthermore, any adjustment to the rolling mill control mechanisms at block 308 that affect the roll gap geometry in order to influence any one of the thickness profile (including crown and/or wedge), centerline thickness and/or flatness and/or position of the metal strip will tend to affect the other measured and/or calculated metal strip parameters. As a result, any changes to roll gap geometry at block 308 to correct an error in one metal strip parameter should also include considerations of the effect of the roll gap geometry change on the other, related metal strip parameters. After the metal strip leaves the rolling mill, a final measurement of the metal strip thickness profile and flatness may be made using an exit metal strip property and position sensor and/or a separate profile gauge such as an x-ray profile gauge and/or flatness roll at block 310. This final measurement of the metal strip parameters, including thickness profile, flatness and/or other properties such as the strip position and temperature, allows the control system to verify that any adjustments made have resulted in the metal strip achieving desired or target ranges for any given measurement of thickness, thickness profile, crown, wedge, flatness and/or the value of any other performance metrics, measurements, or properties. The control system and/or operator may then continue continuously monitoring the measured thicknesses, thickness profile, calculated crown, calculated wedge, centerline thickness, strip position, flatness and/or contour and adjust rolling mill or rolling stand operating conditions as necessary to maintain the metal strip within the desired or target ranges for thickness profile, crown, wedge, flatness and/or other strip properties at block 312.

Still referring to FIG. 3, the control method of blocks 302-312 is described with reference to one or more interstand strip property and position sensors positioned after a first rolling stand. However, the method may be easily adapted for use with one or more interstand metal strip property and position sensors positioned between any pair of rolling stands downstream of a first rolling stand or multiple sets of interstand metal strip property and position sensors between any pair of rolling stands. The use of multiple sets of interstand metal strip property and position sensors may be useful in determining if one or more of the individual rolling stands may be the cause of an out of specification condition in the metal strip. Furthermore, the measured thickness or thickness profile and any values calculated from them may be used to adjust rolling stands either upstream or downstream of that particular interstand metal strip property and position sensor used to take the measured thickness or thickness profile. The method of blocks 302-312 may also incorporate any additional sensors as described with reference to FIG. 1 above, and similarly may adjust the rolling mill 100 and/or rolling stands 102, 104, 106, 108 based upon any of the above described control mechanisms. In certain cases, the method of control of blocks 302-312 may be based on a feedback loop strategy that adjusts the rolling mill and/or upstream rolling mill stands, continues monitoring the interstand metal strip property and position sensors, and continues adjusting in an iterative process to achieve the desired or target values for the centerline thickness, thickness profile, crown, wedge, flatness and/or any other property or parameter of the metal strip. In certain cases, the method of control of blocks 302-312 may use a feed-forward loop strategy to adjust the rolling mill and/or downstream rolling mill stands.

Figure 4:
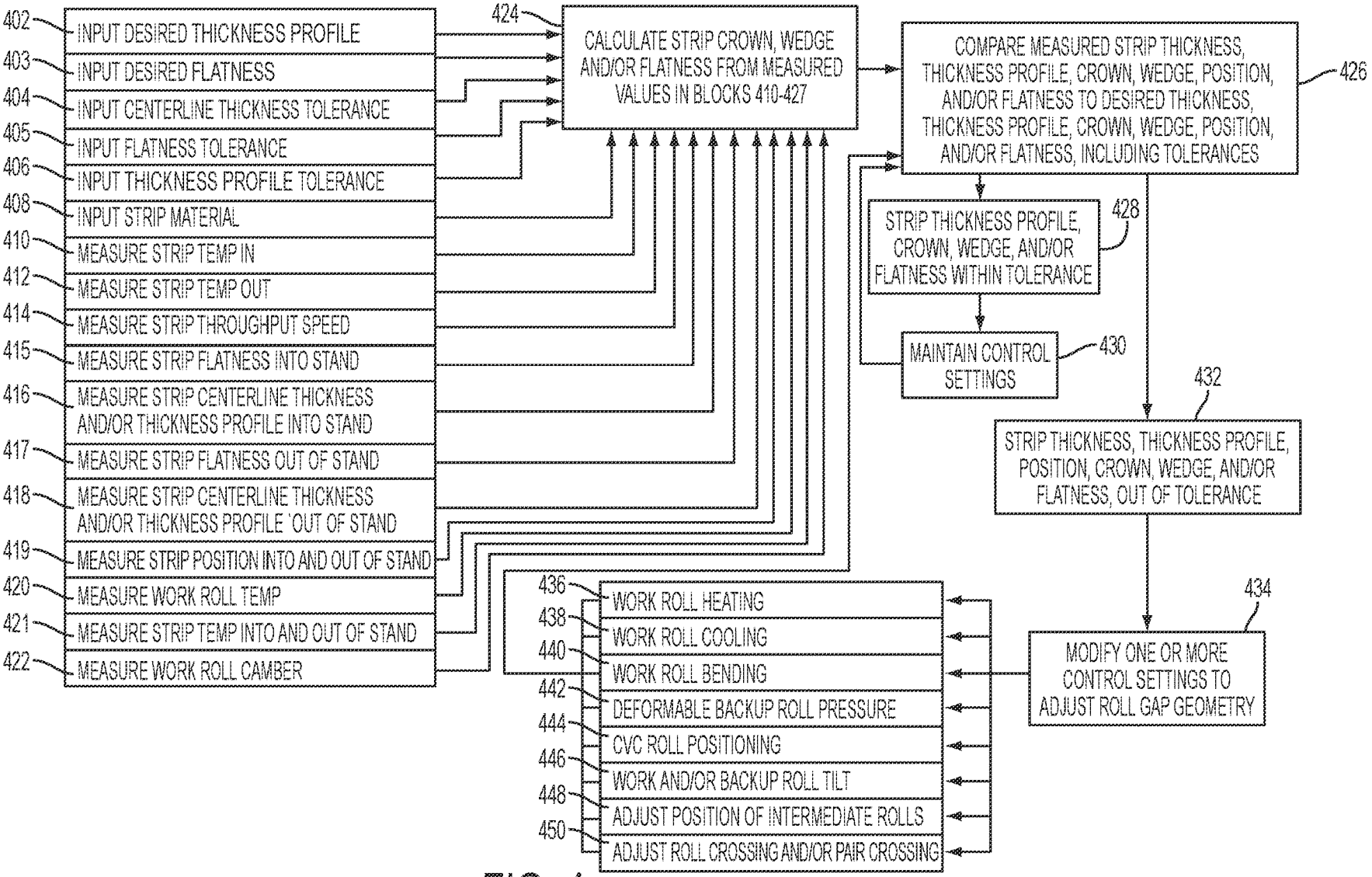
FIG. 4 is a control system for controlling a hot rolling mill with roll camber and interstand metal strip property and position sensors according to one example.

FIG. 4 is a sample control loop for adjusting a rolling mill and/or individual rolling mill stands to maintain or achieve a desired thickness, thickness profile, crown, wedge, flatness and/or any other property or parameter of the metal strip. One or more parameters may be measured and/or input into the control loop. For example, a user may input a desired metal strip thickness profile at block 402, a desired flatness at block 403, a thickness tolerance for the centerline thickness at block 404, a flatness tolerance at block 405, a thickness profile tolerance at block 406, and/or metal strip material at block 408. The control system may then receive values from various sensors, which may be integrated or otherwise in communication with the control system. For example, the control system may receive metal strip temperature entering the rolling mill at block 410, metal strip temperature exiting the rolling mill at block 412, metal strip throughput speed at block 414, metal strip flatness into a rolling stand at block 415, metal strip centerline thickness and thickness profile into a rolling stand at block 416, metal strip flatness out of a rolling stand at block 417, metal strip centerline thickness and thickness profile exiting a rolling stand at block 418, metal strip position into and out of stand at block 419, work roll temperature at block 420, metal strip temperature into and out of stand at block 421, and work roll camber at block 422. In some cases, the control system may use one, multiple, all, or additional unlisted input or measured parameters to determine the applicable metal strip properties and/or desired process outcomes. These measured and/or input values may then be used to calculate the metal strip crown, wedge and/or flatness at block 424. The values of the metal strip thickness, thickness profile, crown, wedge, position and/or flatness may be compared to the desired thickness, thickness profile, crown, position, wedge and/or flatness and any applicable tolerances or allowable variances at block 426. If the measured and/or calculated parameters for the metal strip are within desired ranges at block 428, the control system may maintain the current rolling mill and/or rolling stand settings at block 430. In this case, the control system will continue to monitor the metal strip parameters, measurements and/or properties for any variations or deviations from the desired or target values.

Still referring to FIG. 4, if the measured thickness, thickness profile, calculated crown, position, wedge and/or flatness values do not match the desired values for thickness, thickness profile, crown, wedge, position and/or flatness or within acceptable tolerances of those desired values at block 432, the control system may modify one or more settings to one or more control mechanisms of a rolling stand or the rolling mill to adjust the roll gap geometry, contact pressure, or other variables at block 434. The control system may alter or adjust any applicable control mechanism present on the particular rolling mill or rolling stand. Control mechanisms may include any of the above described control mechanisms of FIG. 1 and/or additional controls as described in this specification that influence the performance and output of the rolling mill or rolling stands. For example, the control system may adjust work roll heating at block 436, work roll cooling at block 438, work roll bending forces at block 440, deformable backup roll pressure at block 442, continuous variable crown work, and/or intermediate roll positioning at block 444, work and/or backup roll tilting at block 446, adjusting the position of intermediate rolls at block 448, and/or adjustment of roll crossing and/or pair crossing parameters at block 450.

The control system may make adjustments to any of the control mechanisms of blocks 436-450 and/or any other control mechanisms or mill processing conditions as described above based on predictive modeling. The control system may take into account the amount of variance between the measured thickness or thickness profile, calculated crown, and/or calculated wedge and their respective desired or target values and determine which control mechanism or mechanisms to adjust and the amount of adjustment necessary. The control system may then continue measuring and receiving information about the metal strip, rolling mill, and/or rolling stands at blocks 402-423, calculate necessary values at block 424, and compare read in and calculated values to the desired values at block 426. In certain cases, the control system may not require predictive modeling and may cycle through iterations of the control loop based on feedback loop or feed-forward loop control. Said differently, the control system will receive inputs and measured values at blocks 402-423, make any necessary calculations at block 424, compare the measured and calculated values of block 424 with desired or target values at block 426, and make any necessary adjustments at blocks 436-450. The control system may then repeat these steps of the control loop adjusting the control mechanisms at blocks 436-450 and comparing values at block 426 until the measured and calculated values for the metal strip properties or parameters fall within their respective desired or target ranges. Once the metal strip properties or parameters are within their respective desired or target ranges, the control system may maintain the control mechanisms at the current settings and continue to compare the measured and calculated values to the inputs.

Figure 5:
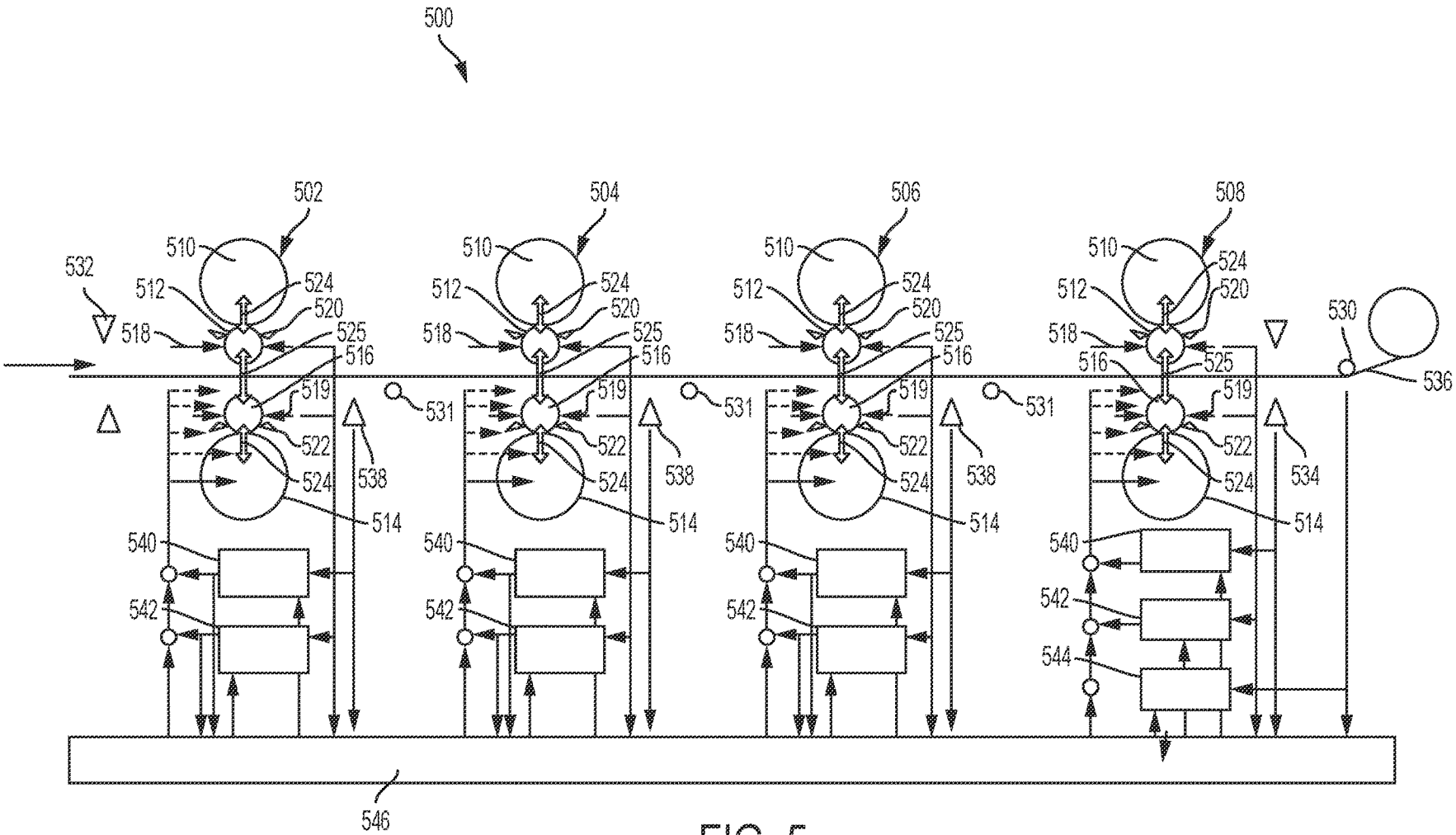
FIG. 5 is a schematic side view of a multi-stand hot rolling mill with roll camber and interstand metal strip property and position sensors integrated into an exemplary control system according to an example.

FIG. 5 is a schematic side view of an exemplary multi-stand rolling mill 500 with various sensors and a control system. The rolling mill 500 comprises a first rolling stand 502, a second rolling stand 504, a third rolling stand 506, and a fourth rolling stand 508. However, the rolling mill 500 may incorporate as few or as many stands as desired. Furthermore, while the rolling stands 502, 504, 506, 508 are described here with numerical order, they may also be described in relative terms as downstream or upstream. For example, as shown, the metal strip 536 will pass through the rolling mill 500 from left to right. Any individual rolling stand 502, 504, 506, 508 that is to the left of another rolling stand 502, 504, 506, 508 may be described as relatively upstream. Similarly, any rolling stand 502, 504, 506, 508 to the right of another rolling stand 502, 504, 506, 508 may be described as relatively downstream. Each individual rolling stand 502, 504, 506, 508 may include an upper backup roll 510, an upper work roll 512, a lower backup roll 514, and a lower work roll 516.

The rolling mill 500 and/or each individual rolling stand 502, 504, 506, 508 includes one or more sensors or measurement devices to monitor a number of rolling mill 500 process conditions and/or metal strip 536 properties or parameters. For example, as shown in FIG. 5, the rolling mill 500 includes, among other things, one or more upper work roll camber sensors 518, one or more lower work roll camber sensors 519, one or more interstand metal strip property and position sensors 538 located between successive rolling stands 502, 504, 506, 508, one or more tension rolls 531, one or more entry metal strip property and position sensors 532, one or more exit metal strip property and position sensors 534 and/or a flatness roll 530. These sensors feed information about the rolling mill 500 and individual rolling stand 502, 504, 506, 508 operating conditions, roll gap geometry, and the properties and parameters of the metal strip 536 into one or more fast loop profile controllers 540, fast loop thermal camber controllers 542, fast loop flatness controllers 544 and/or rolling mill profile controller 546. The controllers 540, 542, 544, 546, in turn, adjust one or more rolling mill control mechanisms based on the measurements and readings of the sensors. In some cases, the rolling mill 500 and/or individual rolling stands 502, 504, 506, 508 may include hot or cold upper sprays 520, hot or cold lower sprays 522, bending forces 524 applied by bending jacks or other roll bending mechanisms, rolling load 525, work roll tilting, continuous variable crown (CVC) work and/or intermediate rolls. The rolling mill 500 and/or rolling stands 502, 504, 506, 508 may also include sensors or measurement devices to monitor any of the metal strip 536 properties or parameters described above and may adjust the operating conditions of the rolling mill 500 and/or individual rolling stands 502, 504, 506, 508 as described above.

Still referring to FIG. 5, the control system for the rolling mill 500 includes both fast and slow loops to control the operating conditions of the individual rolling stands 502, 504, 506, 508 and the rolling mill 500, respectively. The fast control loops monitor and adjust the operating conditions of an individual rolling stand 502, 504, 506, 508 to provide quick response to changing conditions in the rolling mill 500 and compensate for variations or errors in the thickness, thickness profile, crown, wedge, flatness and/or any other properties or parameters of the metal strip 536 during rolling. Simultaneously, the slow loop obtains information about the operating conditions and processes of the rolling mill 500 as a whole. The slow loop then adjusts the control mechanisms of rolling mill 500 and/or individual rolling stands 502, 504, 506, 508 and/or the targets of the fast control loops to both compensate for slower, overall process variation and to maximize the available bending ranges for the rolling mill 500 and/or individual rolling stands 502, 504, 506, 508.

The control system may have any number of different configurations depending upon the particular application, configuration of the rolling mill 500 and/or individual rolling stands 502, 504, 506, 508, and the types and numbers of sensors and rolling mill control mechanisms. For example, the control system may include a slow loop to control the overall rolling mill 500, and then one or more fast loops directed to one or a subset of individual rolling stands 502, 504, 506, 508. In certain cases, each individual rolling stand 502, 504, 506, 508 may have an independent fast control loop. Furthermore, each fast control loop may include one or more sub-loops and one or more controllers. In some cases, both the fast and slow control loops may be carried out by a single controller or processor that monitors the operation of the rolling mill 500 and the individual rolling stands 502, 504, 506, 508. In some cases, information may be shifted or shared between the fast loops of individual rolling stands 502, 504, 506, 508 and/or the slow loop for the rolling mill 500, with corrections for roll gap geometry propagated upstream or downstream to maintain uniform reductions in thickness through the rolling stands 502, 504, 506, 508.

As shown in FIG. 5, the rolling mill 500 may include a slow loop controlled by the rolling mill profile controller 546. The rolling mill profile controller 546 may obtain information from the upper work roll camber measurement sensors 518, lower work roll camber measurement sensors 519, interstand metal strip property and position sensors 538, entry metal strip property and position sensor 532, exit metal strip property and position sensor 534, flatness roll 530 and/or other measured process and metal strip 536 data. The rolling mill profile controller 546 may then compare the information it receives from the sensors to determine whether to adjust any of the rolling mill control mechanisms, such as, but not limited to the upper sprays 520, lower sprays 522, bending force 524, rolling load 525, CVC work and/or intermediate rolls and/or work roll tilt. The rolling mill profile controller 546 may then adjust the roll gap geometry of one or more of the rolling stands 502, 504, 506, 508 to achieve the desired thickness, thickness profile, crown, wedge, flatness and/or other properties or parameters of the metal strip 536. The rolling mill profile controller 546 may also feed target values for the properties or parameters of the metal strip 536 and/or roll gap geometry to one or more of the fast loop profile controllers 540, fast loop thermal camber controllers 542 and/or fast loop flatness controller 544.

Each rolling stand 502, 504, 506, 508 may also have one or more fast control loops having the fast loop profile controller 540 and/or the fast loop thermal camber controller 542. The fast loop profile controller 540 may obtain readings from one or more of the interstand metal strip property and position sensors 538 and/or the entry metal strip property and position sensor 532, and/or the exit metal strip property and position sensor 534. The fast loop profile controller 540 may then compare the readings of thickness, thickness profile, crown, wedge, flatness and/or any other properties or parameters of the metal strip 536 and the mill 500 to its desired values, either as input by an operator or as directed by the slow loop profile controller 546 and determine whether to adjust the upper and lower sprays 520, 522, bending force 524, rolling force 525, CVC work and/or intermediate rolls, work roll tilt and/or any other rolling mill control mechanisms to adjust the roll gap geometry for its associated rolling stand 502, 504, 506, 508. In certain cases, the fast loop profile controller 540 may also direct upstream and/or downstream rolling stands 502, 504, 506, 508 to also adjust their roll gap geometry so as to provide uniform reductions in thickness across the width of the metal strip 536 in other rolling stands and maintain the correct thickness profile. The fast loop profile controller 540 may also output data or other information to the rolling mill profile controller 546.

Similarly, each rolling stand 502, 504, 506, 508 may include a fast loop thermal camber controller 542. In certain cases, the fast loop thermal camber controller may obtain readings of upper work roll 512 and/or lower work roll 516 camber via the upper work roll camber measurement sensors 518 and/or lower work roll camber measurement sensors 519, respectively. The thermal camber controller 542 may then compare the measured upper and/or lower work roll 512, 516 camber to a desired work roll camber, either as input by an operator or as directed by the slow loop profile controller 546. The thermal camber controller 542 may then adjust one or more of the rolling mill control mechanisms, such as, but not limited to, upper and lower sprays 520, 522, for its rolling stand 502, 504, 506, 508. These changes may be directed at achieving a specified roll gap geometry, specific properties or parameters of the metal strip 536, or both. The thermal camber controller 542 may also, in some cases, propagate changes to the upper and/or lower work roll 512, 516 camber in upstream and/or downstream rolling stands 502, 504, 506, 508. In certain cases, the thermal camber controller 542 may also return data or other information to the rolling mill profile controller 546.

The rolling mill 500 may also include one or more fast loop flatness controllers 544, which may be located at the final rolling stand 508 or any other rolling stand 502, 504, 506 that may require direct control of the flatness of the metal strip 536. As shown, the fast loop flatness controller 544 may receive information on the flatness of the metal strip 536 either directly via the flatness roll 530 or indirect via strip angle information form any of the strip property and position sensors 532, 534 or 538. The fast loop flatness controller 544 may then direct one or more of the rolling mill control mechanisms, including, but not limited to, upper and lower sprays 520, 522, bending force 524, rolling force 525, CVC work and/or intermediate rolls and/or work roll tilt to adjust the rolling mill 500 and any individual rolling stand 502, 504, 506, 508 to achieve the desired flatness. The fast loop flatness controller 544 may also output data or other information to the rolling mill profile controller 546.

Throughout the fast and slow loops for the rolling stands 502, 504, 506, 508 and/or rolling mill 500, the fast loop profile controllers 540, fast loop thermal camber controllers 542, fast loop flatness controller 544 and/or rolling mill profile controller 546 may exchange information or otherwise interact with one another to achieve the desired properties and parameters for the metal strip 536. Notably, any change to the roll gap geometry on one rolling stand 502, 504, 506, 508 may require adjustments or alterations in upstream and/or downstream rolling stands 502, 504, 506, 508. Furthermore, any changes to the rolling mill 500 and/or rolling stands 502, 504, 506, 508 will affect the thickness, thickness profile, crown, wedge, flatness and/or other properties or parameters of the metal strip 536 as a group. Therefore, it may be necessary to continually monitor all measured and/or calculated metrics for the metal strip 536 to compensate for any changes that may occur to values that are within acceptable ranges while adjusting the rolling mill control mechanisms to bring an out of range value within an acceptable range. For example, if the flatness of the metal strip 536 is out of range, any changes made to compensate or correct a flatness error may require monitoring of the thickness profile, crown, wedge, or other properties or parameters of the metal strip 536 for any unintended effects that may require additional adjustments or corrections.

Figure 6A:
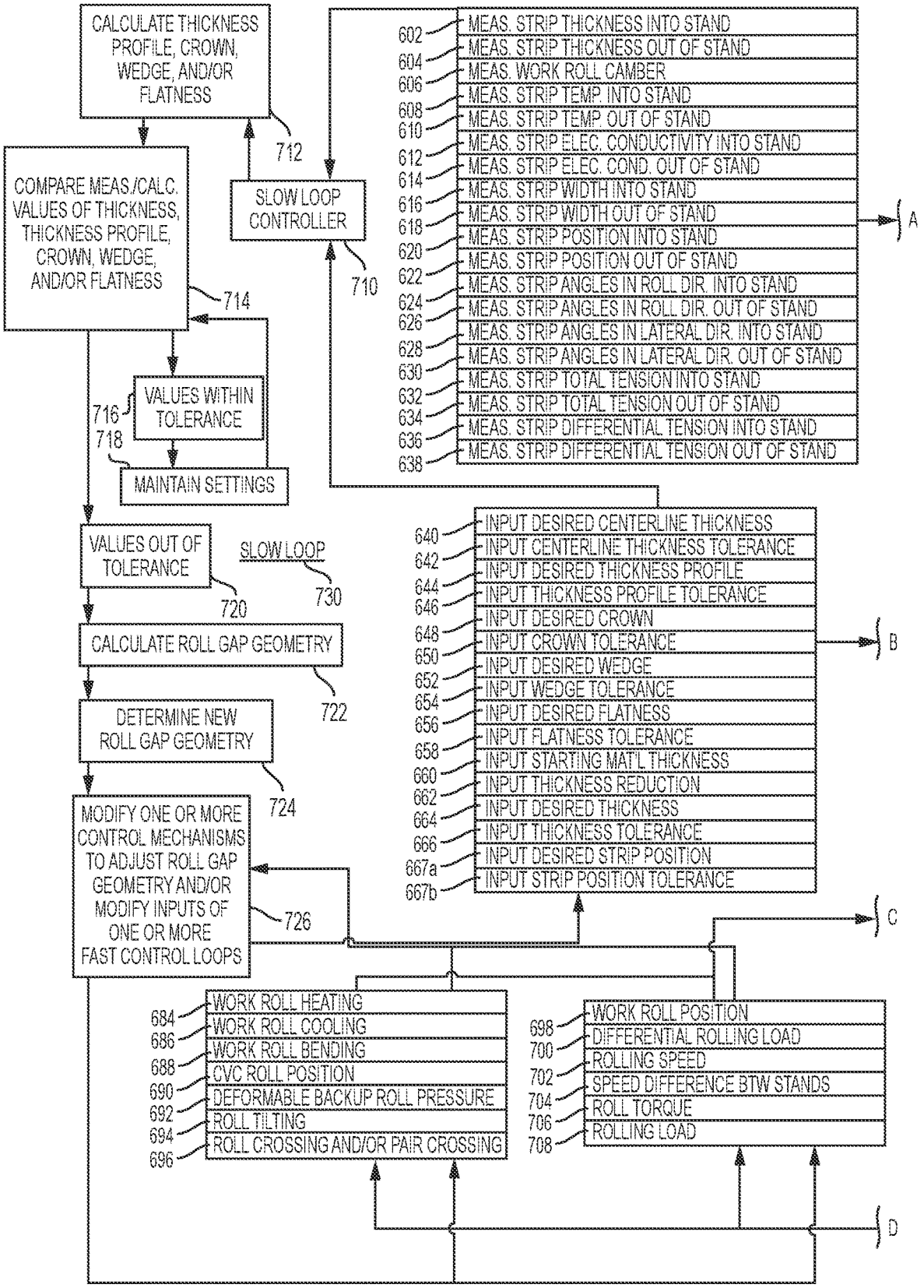
FIGS. 6A and 6B are a control system for controlling a hot rolling mill with roll camber and interstand metal strip property and position with fast and slow control loops, according to one example.
Figure 6B:
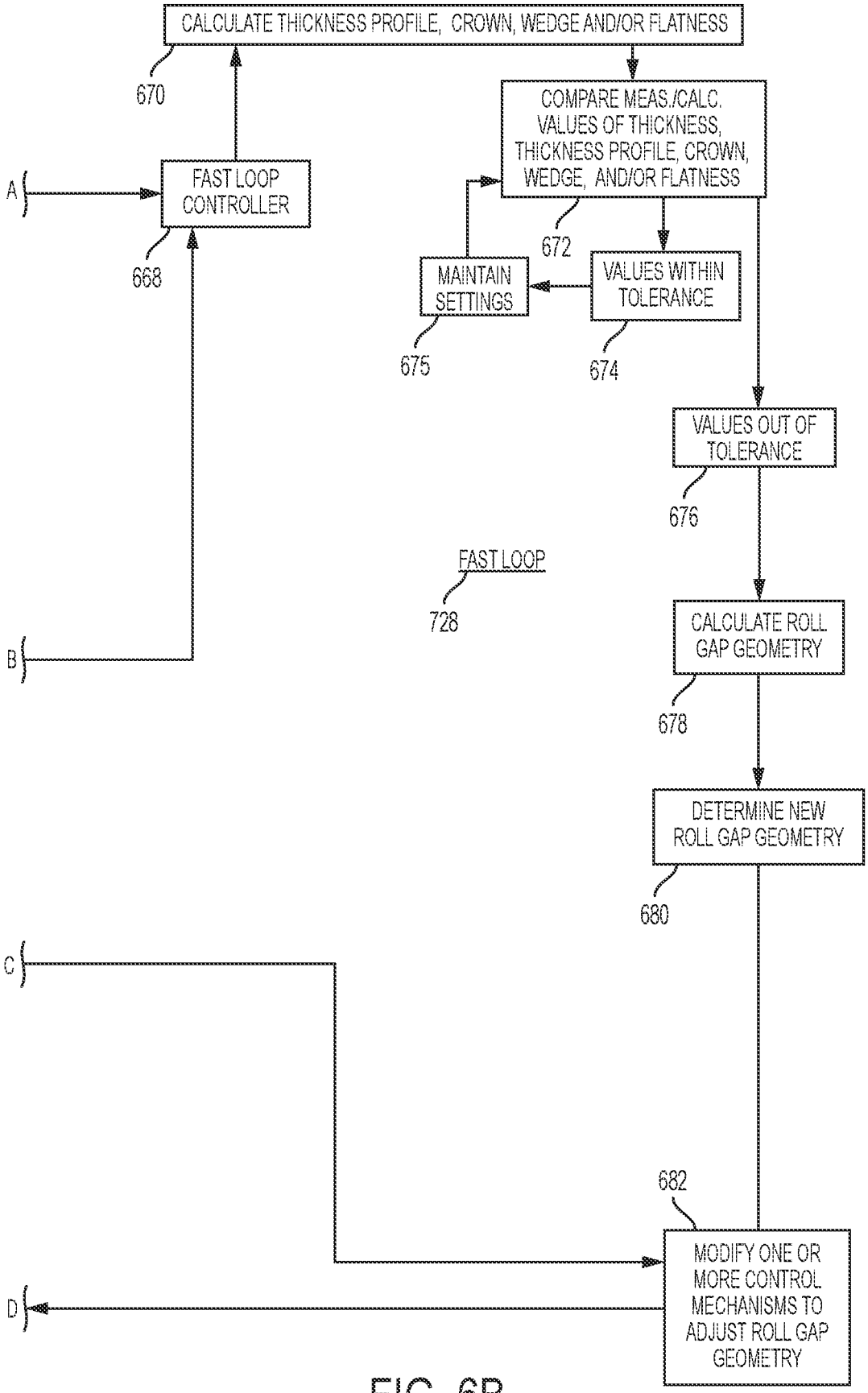

FIGS. 6A and 6B are a sample control method for adjusting a rolling mill and/or individual rolling mill stands using a fast control loop 728 and/or a slow control loop 730. The control method is intended to achieve desired properties or parameters of a metal strip as it is processed by the rolling mill. While a number of measurements, inputs, rolling mill control mechanisms, and a logic path are described below, they are by no means exhaustive lists. Rather, control systems may comprise additional inputs, measurements and/or rolling mill control mechanisms. Furthermore, a control system may include only a subset of the listed steps, or additional steps in use. Instead of the below described feedback control loops also more advanced control methods like predictive control methods may be used to achieve a better performance.

The control system may receive any number of measured or otherwise sensed values from devices such as entrance, interstand and/or exit metal strip property and position sensors, work roll camber measurement sensors, tension rolls, flatness rolls and/or any other sensors or measurement devices as desired or required by a particular application. For example, the control system may read in measured or sensed values for the strip thickness into a stand at block 602, strip thickness out of a stand at block 604, work roll camber at block 606, strip temperature into a stand at block 608, strip temperature out of a stand at block 610, strip electrical conductivity into a stand at block 612, strip electrical conductivity out of a stand at block 614, strip width into a stand at block 616, strip width out of a stand at block 618, strip position into a stand at block 620, strip position out of a stand at block 622, strip angles in the rolling direction into the stand at block 624, strip angles in the rolling direction out of the stand at block 626, strip angles in the lateral direction into the stand at block 628, strip angles in the lateral direction out of the stand at block 630, strip total tension into the stand at block 632, strip total tension out of the stand at block 634, strip differential tension into the stand at block 636 and/or strip differential tension out of the stand at block 638. These measured or sensed values 602-638 may then be sent to a fast loop controller 668.

The fast loop controller 668 may also receive input values from an operator or other controller and/or control system that describe the desired outputs or metrics of the rolling process. For example, the control system may receive input values including, but not limited to, the desired centerline thickness at block 640, centerline thickness tolerance at block 642, desired thickness profile at block 644, thickness profile tolerance at block 646, desired crown at block 648, crown tolerance at block 650, desired wedge at block 652, wedge tolerance at block 654, desired flatness at block 656, flatness tolerance at block 658, starting material thickness at block 660, thickness reduction at block 662, desired thickness at block 664, thickness tolerance at block 666, desired strip position 667*a* and/or strip position tolerance 667*b*.

Once the fast loop controller 668 has received the measured or sensed values 602-638, the fast loop controller 668 may calculate other values such as, but not limited to, the thickness profile, crown, wedge and/or flatness of the strip at block 670. The calculated values of block 670 and/or the measured or sensed values 602-638 may then be compared at block 672 to the desired values of centerline thickness, thickness profile, crown, wedge, flatness and/or desired thickness and/or position from the inputs 640-667*b*. If the calculated values of block 670 and/or measured or sensed values of 602-638 are within the acceptable tolerance of the desired values of the inputs at blocks 640-667*b* at block 674, then the fast loop controller 668 may maintain the current settings at block 675 and continue to compare the measured or sensed values 602-638 and/or calculated values 670 to the inputs 640-667*b*.

If the values are out of tolerance at block 676, the fast loop controller 668 may then use the measured or sensed values 602-638 to calculate the roll gap geometry of the work rolls of one or more rolling stands at block 678. The fast loop controller 668 may then determine, based upon the calculated values at block 670 and the measured or sensed values of block 602-638, the new roll gap geometry at block 680. Because a change to the roll gap geometry for one of the desired values as described by the inputs 640-667*b* may influence other desired values for the inputs 640-667*b*, the fast loop controller 668 may calculate the new roll gap geometry at block 680 based upon the interrelatedness of the inputs 640-667*b*. In some cases, the fast loop controller 668 may calculate the new roll gap geometry at block 680 only to adjust the one or more values that are out of tolerance. The fast loop controller 668 may then monitor the measured or sensed values 602-638 and continue to calculate a new roll gap geometry at block 680 through an iterative process to find the optimal new roll gap geometry.

Once the fast loop controller 668 has determined a new roll gap geometry at block 680, it may adjust one or more rolling mill control mechanisms at block 682. The fast loop controller 668 may adjust one or more rolling mill control mechanisms to influence the roll gap geometry. For example, the rolling mill may include rolling mill control mechanisms such as, but not limited to, work roll heating 684, work roll cooling 686, work roll bending 688, CVC roll positioning 690, deformable backup roll pressure 692, roll tilting 694, roll crossing and/or pair crossing 696, differential strip cooling 697, work roll position 698, differential rolling load 700, rolling speed 702, speed difference between rolling stands 704, roll torque 706 and/or rolling load 708. As a non-limiting example, differential strip cooling may be used to control a strip quench at the exit of a stand by adjusting the flow volume selectively at different zones to control the flatness and the strip temperature at the exit of the quench. Block 682 may also take into account the current values of the rolling mill control mechanisms 684-708 to respect given actuator limits. After adjusting one or more of the rolling mill control mechanisms 684-708, the fast loop controller 668 may continue to monitor the measured or sensed values 602-638 and compare the measured or sensed values 602-638 and/or calculated values 670 with the inputs 640-667*b* at block 672 throughout the rolling mill production cycle.

A slow loop 730 operates on similar principles as the fast loop 728. A slow loop controller 710 may receive measured or sensed values 602-638 and inputs 640-667*b*. The slow loop controller 710 may then calculate values such as the thickness profile, crown, wedge and/or flatness at block 712. The measured or sensed values 602-638 and/or calculated values 712 may be compared to the inputs 640-667*b* at block 714. If the values are within tolerance at block 716, the slow loop controller 710 may maintain the current settings at block 718 and continue to monitor the rolling mill processes.

If one or more of the measured or sensed values 602-638 and/or calculated values 712 are not within the tolerance of the inputs 640-667*b* at block 720, the slow loop controller 710 may calculate the current roll gap geometry at block 722 and determine a new roll gap geometry at block 724. As described above, the slow loop controller 710 may determine the new roll gap geometry at block 724 while taking into account the interrelatedness of the effects of changing the roll gap geometry to bring one of the measured or sensed values 602-638 and/or calculated values 712 within tolerances of the inputs 640-667*b* and subsequently affecting one or more of the other measured or sensed values 602-638 and/or calculated values 712. In some cases, the slow loop controller 710 may also change the roll gap geometry to bring the one or more measured or sensed values 602-638 and/or calculated values 712 within tolerance and continue an iterative process for determining a new roll gap geometry at block 724 until all of the measured or sensed values 602-638 and/or calculated values 712 are within the tolerances of the inputs 640-667*b*.

Once the slow loop controller 710 has determined a new roll gap geometry at block 724, it may then adjust one or more of the rolling mill control mechanisms 684-708 at block 726. Block 726 may also take into account the current values of the rolling mill control mechanisms 684-708 to respect given actuator limits and/or change one or more input values 640-667*b* for the fast control loops. In some cases, the slow loop controller may take into account operator feedback on certain parameters or properties. By way of example, in some cases, a flatness roll may not be included with a rolling mill, and the operator may provide feedback on achieved flatness.

Though the fast loop 728 and slow loop 730 use similar logical pathways, the fast loop 728 and slow loop 730 may perform different functions. The slow loop 730 operates to control the overall rolling mill and its production process. The slow loop 730 may also function to allow the rolling mill to compensate for relatively larger time scale changes in the rolling mill process using certain rolling mill control mechanisms and to allow roll bending, which may be a faster responding rolling mill control mechanism, to retain maximum variability for the fast loop 728. The fast loop 728, by contrast, may be used to quickly alter or adjust the roll gap geometry to maintain proper rolling mill function during transient or other relatively fast moving changes to the rolling process. In certain cases, the overall control system may include multiple fast loops 728. For example, a rolling mill with multiple rolling stands may have a fast loop 728 for each rolling stand or any subset thereof. Also, there may be transfers of instructions and/or data between individual fast loops 728 and/or the slow loop 730. The slow loop 730 may provide instructions and/or data to one or more fast loops 728 or vice versa. Similarly, individual fast loops 728 may exchange instructions and/or data, and roll gap geometry changes may be propagated upstream or downstream in the rolling mill, to ensure even reductions in thickness and maintenance of a desired thickness profile, crown, wedge and/or flatness as the metal strip passes through individual rolling stands.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A method comprising: measuring a thickness profile of a metal strip with a thickness profile measurement sensor, wherein the thickness profile measurement sensor is disposed at one of an entry side or an exit side of a rolling mill stand of a rolling mill; measuring a flatness of the metal strip with a flatness measurement sensor, wherein the flatness measurement sensor is disposed at one of the entry side or the exit side of the rolling mill stand; measuring a camber of a roll of the rolling mill with a roll camber sensor; measuring a roll gap geometry of the rolling mill stand with a roll gap geometry sensor; receiving data at a controller from at least one of the thickness profile measurement sensor, the flatness measurement sensor, the roll camber sensor, or the roll gap geometry sensor; and adjusting, by the controller, a rolling mill control mechanism such that the roll gap geometry provides a desired thickness profile and a desired flatness of the metal strip within predefined tolerances.

EC 2. The method of any preceding or subsequent example combinations, wherein adjusting the rolling mill control mechanism comprises adjusting the camber of the roll such that a bending range is within a predefined range.

EC 3. The method of any preceding or subsequent example combinations, wherein the metal strip is a first metal strip, and wherein adjusting the rolling mill control mechanism comprises adjusting the camber of the roll such that the roll gap geometry of the first metal strip matches a roll gap geometry of a subsequent metal strip.

EC 4. The method of any preceding or subsequent example combinations, wherein adjusting the rolling mill control mechanism comprises minimizing at least one of a roll cooling time and a roll heating time of the roll.

EC 5. The method of any preceding or subsequent example combinations, wherein the rolling mill stand is a first rolling mill stand, and wherein adjusting the rolling mill control mechanism comprises adjusting a roll gap geometry of a second rolling mill stand downstream from the first rolling mill stand to maintain the thickness profile and the flatness of the metal strip.

EC 6. The method of any preceding or subsequent example combinations, wherein the rolling mill stand is one rolling mill stand of a plurality of rolling mill stands, and wherein adjusting the rolling mill control mechanism comprises adjusting the roll gap geometry of the plurality of rolling mill stands to create a symmetric profile of the metal strip.

EC 7. The method of any preceding or subsequent example combinations, wherein the rolling mill stand is one rolling mill stand of a plurality of rolling mill stands, and wherein adjusting the rolling mill control mechanism comprises implementing profile changes of the metal strip in at least two of the plurality of rolling mill stands.

EC 8. The method of any preceding or subsequent example combinations, wherein implementing profile changes in at least two of the plurality of rolling mill stands comprises accounting for thermal conditions of the roll in the plurality of rolling mill stands.

EC 9. The method of any preceding or subsequent example combinations, wherein adjusting the rolling mill control mechanism comprises calibrating a thermal model of a setup model based on at least one of a measured thermal condition and a calculated thermal condition of the roll.

EC 10. The method of any preceding or subsequent example combinations, wherein the roll is an upper roll, and wherein measuring a thermal condition of the roll, measuring the camber of the roll, and measuring the roll gap geometry comprises at least one of: measuring the roll gap geometry with ultrasonic sensing while the upper roll is rolling; measuring the roll gap geometry by measuring a distance between the upper roll and a lower roll with a laser; measuring the camber of the upper roll and the lower roll with ultrasonic sensing; calculating the roll gap geometry based on a difference between an ingoing thickness profile and an outgoing thickness profile, the flatness, and rolling condition information; calculating the roll gap geometry based on roll camber measurements, and the rolling condition information; or calculating the roll camber of the roll based on roll gap geometry measurements, and the rolling condition information.

EC 11. The method of any preceding or subsequent example combinations, wherein the rolling condition information is at least one of a rolling load measurement and a bending force measurement.

EC 12. The method of any preceding or subsequent example combinations, wherein measuring the thickness profile of the metal strip comprises measuring multiple thicknesses across a face of the metal strip.

EC 13. The method of any preceding or subsequent example combinations, wherein the rolling mill stand is a first rolling mill stand, and wherein the method further comprises: adjusting the first rolling mill stand and a second rolling mill stand downstream from the first rolling mill stand with the rolling mill control mechanism to maintain the thickness profile of the metal strip through the second rolling mill stand, wherein the adjusting of the rolling mill stands with the rolling mill control mechanism is based on at least one of the measuring of the camber of the roll of the rolling mill or the measuring of the roll gap geometry of the rolling mill stand of the rolling mill.

EC 14. The method of any preceding or subsequent example combinations, further comprising: measuring at least one additional process parameter of the rolling mill; and adjusting the at least one additional process parameter of the rolling mill to provide the roll gap geometry of the rolling mill stand of the rolling mill to maintain the thickness profile and the flatness of the metal strip to the desired thickness profile and the flatness within the thickness profile and the flatness tolerances.

EC 15. The method of any preceding or subsequent example combinations, wherein the rolling mill control mechanism comprises an actuator in the rolling mill stand or at an interstand position, wherein the actuator comprises at least one of: positive and negative roll bending; heating and cooling of the roll; controlling the positioning of a continuously variable crown roll or an intermediate roll; deforming a deformable backup roll; roll tilting; roll crossing and pair crossing; differential strip cooling and heating; rolling load and differential rolling load; rolling speed; and dynamic shifting of thickness reductions within a plurality of rolling mill stands.

EC 16. The method of any preceding or subsequent example combinations, further comprising controlling the rolling mill control mechanism based on at least one of: one or more feedback loops; one or more feed-forward loops; and advanced control methods such as model predictive control.

EC 17. The method of any preceding or subsequent example combinations, wherein the measuring of the thickness profile of the metal strip comprises measuring the thickness profile of the metal strip with an eddy current sensor.

EC 18. The method of any preceding or subsequent example combinations, further comprising fast control loops and slow control loops.

EC 19. The method of any preceding or subsequent example combinations, further comprising at least one of: controlling a thickness profile and a flatness target at the exit of the rolling mill stand with the fast control loops; controlling the thermal camber of the roll with the fast control loops; optimizing available bending ranges with the slow control loops; correcting a thickness profile target and a flatness target at the exit of the rolling mill stand with the slow control loops; optimizing a thermal condition of the roll for product transitions by adjusting the targets of the fast control loops via the rolling mill control mechanism.

EC 20. A method comprising: measuring a roll gap geometry of at least one rolling stand of a rolling mill; measuring a thickness profile of a metal strip between one or more upstream stands and one or more downstream stands at a first interstand location of the rolling mill after the metal strip has passed through the one or more upstream stands; comparing the thickness profile of the metal strip to a desired thickness profile; and adjusting the one or more upstream stands with one or more rolling mill control mechanisms to provide a roll gap geometry of the one or more upstream stands that matches the thickness profile of the metal strip to the desired thickness profile within a thickness profile tolerance.

EC 21. The method of any preceding or subsequent example combinations, further comprising calculating a crown of the metal strip from the thickness profile of the metal strip; comparing the crown to a desired crown; and adjusting the one or more upstream stands with the one or more rolling mill control mechanisms to match the crown to the desired crown within a crown tolerance.

EC 22. The method of any preceding or subsequent example combinations, wherein the measuring the thickness profile of the metal strip comprises measuring multiple thicknesses across a face of the metal strip.

EC 23. The method of any preceding or subsequent example combinations, wherein the one or more rolling mill control mechanisms influence the roll gap geometry of the at least one rolling stand of the rolling mill.

EC 24. The method of any preceding or subsequent example combinations, further comprising adjusting the one or more downstream stands with the one or more rolling mill control mechanisms to maintain the thickness profile of the metal strip through the one or more downstream stands, wherein the adjusting of the one or more downstream stands with the one or more rolling mill control mechanisms is based on measuring the roll gap geometry of the at least one rolling stand of the rolling mill.

EC 25. The method of any preceding or subsequent example combinations, further comprising: measuring at least one additional process parameter of the rolling mill; and adjusting the at least one additional process parameter of the rolling mill to provide the roll gap geometry of the at least one rolling stand of the rolling mill to maintain the thickness profile of the metal strip to the desired thickness profile within the thickness profile tolerance.

EC 26. The method of any preceding or subsequent example combinations, further comprising: adjusting the one or more rolling mill control mechanisms to provide a work roll camber of the at least one rolling stand of the rolling mill, wherein the work roll camber of the at least one rolling stand provides the roll gap geometry of the at least one rolling stand such that an available bending range is maximized.

EC 27. The method of any preceding or subsequent example combinations, wherein the one or more rolling mill control mechanisms comprises bending at least one work roll of the at least one rolling stand.

EC 28. The method of any preceding or subsequent example combinations, wherein the one or more rolling mill control mechanisms comprises at least one of heating at least one work roll of the at least one rolling stand, cooling at least one work roll of the at least one rolling stand, controlling the positioning of a continuously variable crown work roll or intermediate roll, or deforming a deformable backup roll.

EC 29. The method of any preceding or subsequent example combinations, wherein measuring the roll gap geometry of at least one rolling mill comprises measuring the roll gap geometry of a plurality of rolling stands of the rolling mill.

EC 30. The method of any preceding or subsequent example combinations, further comprising controlling the one or more rolling mill control mechanisms based on a feedback loop or feed-forward loop.

EC 31. The method of any preceding or subsequent example combinations, further comprising measuring at least one additional thickness at a second interstand location of the rolling mill, wherein the at least one additional thickness is measured between the one or more upstream stands and the one or more downstream stands of the rolling mill.

EC 32. The method of any preceding or subsequent example combinations, wherein measuring the roll gap geometry of the plurality of rolling stands of the rolling mill comprises ultrasonic sensing of the roll gap geometry.

EC 33. The method of any preceding or subsequent example combinations, further comprising measuring a flatness of the metal strip after the metal strip leaves the rolling mill with a flatness roll; and adjusting at least one of the one or more upstream stands or the one or more downstream stands with the one or more rolling mill control mechanisms to provide the roll gap geometry of the one or more upstream stands or the one or more downstream stands to match the flatness of the metal strip to a desired flatness of the metal strip within a flatness tolerance.

EC 34. The method of any preceding or subsequent example combinations, wherein the one or more rolling mill control mechanisms comprises applying differential cooling to the metal strip.

EC 35. The method of any preceding or subsequent example combinations, wherein the measuring the thickness profile of the metal strip comprises measuring the thickness profile of the metal strip with an eddy current sensor.

EC 36. A rolling mill control system comprising: at least one thickness profile measurement sensor for measuring a thickness profile of a metal strip, wherein the at least one thickness profile measurement sensor is disposed between one or more upstream stands and one or more downstream stands at a first interstand location of a rolling mill having a plurality of rolling stands; at least one roll camber sensor for measuring a camber of at least one of a plurality of work rolls; a rolling mill control mechanism; and a controller; wherein the controller receives data from the at least one thickness profile measurement sensor and the at least one roll camber sensor and adjusts the rolling mill control mechanism such that a roll gap geometry of at least one of the plurality of rolling stands is configured to produce a desired thickness profile of the metal strip.

EC 37. The rolling mill control system of any preceding or subsequent example combinations, wherein the rolling mill control mechanism comprises a work roll bending mechanism.

EC 38. The rolling mill control system of any preceding or subsequent example combinations, wherein the rolling mill control mechanism comprises a work roll heating or cooling system.

EC 39. The rolling mill control system of any preceding or subsequent example combinations, wherein the rolling mill control mechanism comprises a deformable backup roll, a continuously variable crown work roll, or a continuously variable crown intermediate roll.

What is claimed is:

1. A rolling mill comprising:

a first work stand defining a first roll gap;

a second work stand downstream from the first work stand and comprising an upper work roll, a lower work roll, and a roll tilt actuator, wherein the upper work roll and the lower work roll define a second roll gap, wherein the first work stand and the second work stand are adapted to receive a metal substrate moving along a pass line, and wherein the roll tilt actuator is configured to control an inclination of at least one of the upper work roll or the lower work roll relative to the pass line;

a strip sensor at an interstand location along the pass line between the first work stand and the second work stand, wherein the strip sensor is configured to measure a parameter of the metal substrate at the interstand location; and a controller operably coupled to the roll tilt actuator and the strip sensor, wherein the controller is configured to receive sensor data from the strip sensor comprising the measured parameter of the metal substrate, compare the measured parameter to a target parameter, and actuate the roll tilt actuator such that the measured parameter is within a predefined tolerance of the target parameter, wherein the strip sensor is a strip property sensor, wherein the rolling mill further comprises a position sensor along the pass line between the first work stand and the second work stand, wherein the position sensor is configured to detect a relative location of the metal substrate, and wherein the controller is configured to:

determine a three-dimensional position of the metal substrate based on the measured parameter from the strip property sensor and the detected relative location of the metal substrate from the position sensor; and actuate the roll tilt actuator such that the determined three-dimensional position is within a predefined tolerance of a target position.

2. The rolling mill of claim 1, wherein the second work stand is a last work stand of the rolling mill, wherein the rolling mill further comprises an exit sensor downstream from the last work stand, wherein the exit sensor is operably connected to the controller and is configured to measure an exit parameter of the metal substrate after the last work stand, and actuate the roll tilt actuator based on the measured exit parameter.

3. The rolling mill of claim 2, wherein the exit sensor comprises a thickness sensor configured to measure a thickness of the metal substrate across a width of the metal substrate after the last work stand.

4. The rolling mill of claim 2, wherein the exit sensor comprises a flatness sensor configured to measure a flatness of the metal substrate across a width of the metal substrate after the last work stand.

5. The rolling mill of claim 1, wherein the strip sensor comprises a tension sensor, a temperature sensor, a width sensor, or a thickness sensor.

6. The rolling mill of claim 1, wherein the measured parameter comprises a thickness of the metal substrate across a width of the metal substrate.

7. The rolling mill of claim 1, wherein the controller is further configured to calibrate a setup model of the second work stand based on the measured parameter.

8. The rolling mill of claim 1, wherein the controller is further configured to calculate a second parameter of the metal substrate based on the measured parameter, compare the calculated second parameter with a target second parameter, and actuate the roll tilt actuator such that the calculated second parameter is within a predefined tolerance of the target second parameter.

9. The rolling mill of claim 1, wherein the target position is a centerline of the upper work roll and the lower work roll of the second work stand.

10. A method comprising:

receiving a metal substrate moving along a pass line in a first roll gap of a first work stand of a rolling mill;

receiving the metal substrate moving along the pass line in a second roll gap of a second work stand of the rolling mill, wherein the second work stand is downstream from the first work stand and comprises an upper work roll, a lower work roll, and a roll tilt actuator, wherein the upper work roll and the lower work roll define the second roll gap, wherein the roll tilt actuator is configured to control an inclination of at least one of the upper work roll or the lower work roll relative to the pass line;

measuring a parameter of the metal substrate with a strip sensor at an interstand location along the pass line between the first work stand and the second work stand;

comparing the measured parameter to a target parameter; and actuating the roll tilt actuator such that the measured parameter is within a predefined tolerance of the target parameter, wherein measuring the parameter comprises measuring a strip property parameter of the metal substrate, and wherein the method further comprises:

detecting a relative location of the metal substrate with a position sensor between the first work stand and the second work stand;

determining a three-dimensional position of the metal substrate based on the measured strip property parameter and the detected relative location of the metal substrate; and actuating the roll tilt actuator such that the determined three-dimensional position is within a predefined tolerance of a target position.

11. The method of claim 10, wherein the second work stand is a last work stand of the rolling mill, wherein the method further comprises measuring an exit parameter of the metal substrate after the last work stand, and wherein actuating the roll tilt actuator comprises actuating the roll tilt actuator based on the measured exit parameter.

12. The method of claim 11, wherein actuating the roll tilt actuator based on the measured exit parameter comprises actuating the roll tilt actuator based on a measured exit thickness of the metal substrate across a width of the metal substrate after the last work stand.

13. The method of claim 11, wherein actuating the roll tilt actuator based on the measured exit parameter comprises actuating the roll tilt actuator based on a measured exit flatness of the metal substrate after the last work stand.

14. The method of claim 10, wherein measuring the parameter comprises measuring at least one of a tension in the metal substrate, a temperature of the metal substrate, a width of the metal substrate, or a thickness of the metal substrate.

15. The method of claim 10, further comprising calibrating a setup model of the second work stand based on the measured parameter.

16. The method of claim 10, further comprising calculating a second parameter of the metal substrate based on the measured parameter, comparing the calculated second parameter with a target second parameter, and actuating the roll tilt actuator such that the calculated second parameter is within a predefined tolerance of the target second parameter.

17. The method of claim 10, wherein actuating the roll tilt actuator comprises actuating the roll tilt actuator such that the determined three-dimensional position is within a predefined tolerance of a centerline of the upper work roll and the lower work roll of the second work stand.

18. A method comprising:

measuring a thickness profile of a metal substrate with a thickness profile measurement sensor, wherein the thickness profile measurement sensor is disposed at an interstand location between work stands of a rolling mill;

measuring a flatness of the metal substrate with a flatness measurement sensor, wherein the flatness measurement sensor is disposed downstream from a last work stand of the rolling mill;

receiving data at a controller from the thickness profile measurement sensor and the flatness measurement sensor;

detecting a relative location of the metal substrate with a position sensor between a first work stand of the work stands and a second work stand of the work stands;

determining a three-dimensional position of the metal substrate based on the measured thickness profile and the detected relative location of the metal substrate; and actuating, by the controller, a roll tilt actuator such that a work stand of the rolling mill provides a desired thickness profile and a desired flatness of the metal substrate within predefined tolerances and wherein actuating comprises actuating such that the determined three-dimensional position is within a predefined tolerance of a target position.

* * * * *